US011071431B2

(12) United States Patent
Windmeisser et al.

(10) Patent No.: US 11,071,431 B2
(45) Date of Patent: Jul. 27, 2021

(54) FLOOR CLEANING APPARATUS AND METHOD OF CLEANING A FLOOR

(71) Applicant: Diversey, Inc., Charlotte, NC (US)

(72) Inventors: Dieter Windmeisser, Fruthwilen (CH); Thomas Bahr, Wängi (CH); Markus Müller, Hettlingen (CH); Martin Forster, Riedt bei Erlen (CH); Markus Stofer, Kreuzlingen (CH); Laurent Ryssen, Vieux Genappe (BE); Thomas Tement, Widnau (CH)

(73) Assignee: Diversey, Inc., Fort Mill, SC (US)

( * ) Notice: Subject to any disclaimer, the term of this patent is extended or adjusted under 35 U.S.C. 154(b) by 438 days.

(21) Appl. No.: 16/194,493

(22) Filed: Nov. 19, 2018

(65) Prior Publication Data

US 2019/0082921 A1 Mar. 21, 2019

Related U.S. Application Data

(62) Division of application No. 15/221,753, filed on Jul. 28, 2016, now Pat. No. 10,130,231.

(Continued)

(51) Int. Cl.
*E01H 1/08* (2006.01)
*A47L 11/00* (2006.01)

(Continued)

(52) U.S. Cl.
CPC ..... *A47L 11/305* (2013.01); *A47L 11/24* (2013.01); *A47L 11/28* (2013.01); *A47L 11/282* (2013.01);

(Continued)

(58) Field of Classification Search
CPC .... A47L 11/16; A47L 11/283; A47L 11/4038; A47L 11/305; A47L 11/282;

(Continued)

(56) References Cited

U.S. PATENT DOCUMENTS 3,201,819 A 8/1965 Wilgus
3,277,511 A * 10/1966 Little ..... A47L 11/00 15/320

(Continued)

FOREIGN PATENT DOCUMENTS

EP 2685004 A1 1/2014
JP 2010035773 A 2/2010

(Continued)

OTHER PUBLICATIONS

Extended European Search Report from the European Patent Office, dated Jan. 19, 2017.

(Continued)

*Primary Examiner* — Bryan R Muller
(74) *Attorney, Agent, or Firm* — Andrew Aranda; Diversey, Inc.

(57) ABSTRACT

An apparatus for cleaning a floor includes a housing, chassis, wheels, motor, steering mechanism, cleaning assembly, optionally a squeegee assembly, and at least one of a side sweeping system, front sweeping system, and pick-up system. The side sweeping system includes a turntable with central axis, a drive wheel disposed in coaxial relationship with the turntable, a sweeper motive device in communication with the drive wheel, a plurality of brushes distributed radially around the drive wheel and adapted to be driven by rotation of the drive wheel, and a pivoting connector configured to enable the side sweeping system to pivot laterally in response to contact with a wall while at least one of the brushes maintains contact with the floor adjacent the wall while the apparatus is in operation, and the brushes move debris disposed on the floor adjacent the wall toward the front of the apparatus.

20 Claims, 17 Drawing Sheets

Related U.S. Application Data

(60) Provisional application No. 62/199,282, filed on Jul. 31, 2015.

(51) Int. Cl.

| | |
|---|---|
| ***A47L 11/30*** | (2006.01) |
| ***A47L 11/293*** | (2006.01) |
| ***E01H 1/05*** | (2006.01) |
| ***A47L 11/24*** | (2006.01) |
| ***A47L 11/28*** | (2006.01) |
| ***A47L 11/282*** | (2006.01) |
| ***A47L 11/283*** | (2006.01) |
| ***A47L 11/40*** | (2006.01) |

(52) U.S. Cl.

CPC ..... *A47L 11/283* (2013.01); *A47L 11/293* (2013.01); *A47L 11/307* (2013.01); *A47L 11/4038* (2013.01); *E01H 1/053* (2013.01); *A47L 11/4016* (2013.01); *A47L 11/4044* (2013.01); *A47L 11/4055* (2013.01); *A47L 11/4061* (2013.01); *A47L 11/4066* (2013.01); *A47L 11/4069* (2013.01); *A47L 11/4072* (2013.01); *A47L 11/4083* (2013.01); *A47L 11/4088* (2013.01)

(58) Field of Classification Search

CPC .. A47L 11/307; A47L 11/2025; A47L 11/293; E01H 1/053

USPC ..... 15/386

See application file for complete search history.

(56) References Cited

U.S. PATENT DOCUMENTS

| | | | | |
|---|---|---|---|---|
| 3,866,541 | A * | 2/1975 | O'Connor | A47L 11/30 15/320 |
| 7,313,839 | B2 * | 1/2008 | Shinler | A47L 11/24 15/49.1 |
| 7,950,106 | B2 | 5/2011 | Oberhaensli et al. | |
| 8,201,296 | B2 | 6/2012 | Mayer | |
| 8,769,755 | B2 | 7/2014 | Hetler | |
| 9,498,099 | B2 * | 11/2016 | Shinler | A47L 11/24 |
| 2002/0138939 | A1 * | 10/2002 | Smith | E01H 1/047 15/340.4 |
| 2010/0180390 | A1 | 7/2010 | Lintern | |
| 2011/0107529 | A1 * | 5/2011 | Hetler | E01H 1/053 15/21.1 |
| 2014/0101874 | A1 * | 4/2014 | Du Maire | E01H 1/053 15/87 |

FOREIGN PATENT DOCUMENTS

| | | | |
|---|---|---|---|
| JP | 2014523983 | A | 9/2014 |
| WO | 2012171579 | A1 | 12/2012 |

OTHER PUBLICATIONS

Office Action of counterpart patent application No. JP2019-149400 dated Nov. 12, 2019; 2 pages.

* cited by examiner

FLOOR CLEANING APPARATUS AND METHOD OF CLEANING A FLOOR

FIELD OF THE INVENTION

This invention relates to a floor cleaning apparatus with at least one of a side sweeping system, front sweeping system, and pick-up system. The invention also relates to a method of cleaning a floor.

BACKGROUND OF THE INVENTION

Various powered floor cleaning machines are known in the art, including those in which the operator is standing on the floor and walking behind the machine ("walk-behind" machines), those in which the operator is sitting on the machine ("ride-on" machines), and those in which the operator is standing on the machine ("stand-on" machines). A Some machines provide wet scrubbing of a floor surface, usually with a squeegee assembly, such as one that includes a vacuum system for picking up soiled water resulting from the wet scrubbing process.

A well-known problem for powered floor cleaners is the pick-up of debris in front of and at the side of the cleaning path of the cleaner. Some commercial machines address this problem with so-called presweepers in various configurations. A unit with cylindrical brushes sweeps the cleaning path in front of the machine and collects the dirt in a bin. Other commercial machines use a side brush that sweeps debris from the side of the cleaning path. Such devices unfortunately increase the overall footprint of the machines. This can considerably reduce maneuverability, reduce the effective reach of wet cleaning in corners, require higher energy consumption thus reducing machine autonomy by requiring more frequent battery recharging, and/or generate dust due to high rotational speed. These devices tend to complicate the cleaning system and add expense. Another method to address this issue is a manual sweeping process before the wet-cleaning process is begun. This can be time-consuming, and therefore is often neglected. Missing the pre-sweeping process can lead to streaking of the floor surface as debris is caught under the squeegee. Suction performance can be reduced, resulting in impairment of or even blockage of the suction system.

SUMMARY OF THE INVENTION

In a first aspect, a floor cleaning apparatus for cleaning a floor comprises a housing; a chassis; a plurality of wheels by which the floor cleaning apparatus is adapted to move across the floor in a direction of travel, the direction of travel at least partially defining a front end, a back end, and first and second lateral sides of the floor cleaning apparatus, a motive device for moving the apparatus across the floor, a steering mechanism, a cleaning assembly for cleaning the floor, and a side sweeping system comprising a turntable having a central axis, a drive wheel, the drive wheel disposed in coaxial relationship with the turntable, a sweeper motive device in operative communication with the drive wheel, a plurality of driven brushes, each having a central axis, the brushes distributed radially around the drive wheel and adapted to be driven by rotation of the drive wheel, and a pivoting connector configured to enable the side sweeping system to pivot laterally in response to contact with a wall while at least one of the plurality of driven brushes maintains contact with the floor adjacent the wall while the floor cleaning apparatus is in operation, and the brushes move debris that is disposed on the floor adjacent the wall toward the front of the floor cleaning apparatus.

In a second aspect, a method for cleaning a floor comprises providing a floor cleaning apparatus for cleaning a floor, the apparatus adapted to traverse a path of travel, comprising a housing, a chassis, a plurality of wheels by which the floor cleaning apparatus is adapted to move across the floor in a direction of travel, the direction of travel at least partially defining a front end, a back end, and first and second lateral sides of the floor cleaning apparatus, a motive device for moving the apparatus across the floor, a steering mechanism, a cleaning assembly for cleaning the floor, and a side sweeping system comprising a turntable having a central axis, a drive wheel, the drive wheel disposed in coaxial relationship with the turntable, a sweeper motive device in operative communication with the drive wheel, a plurality of driven brushes each having a central axis, the brushes distributed radially around the drive wheel, the brushes adapted to be driven by rotation of the drive wheel, and a pivoting connector configured to enable the side sweeping system to pivot laterally in response to contact with a wall while at least one of the plurality of driven brushes maintains contact with the floor adjacent the wall while the floor cleaning apparatus is in operation, and navigating the apparatus across the floor such that the brushes move debris that is disposed on the floor adjacent the wall toward the front of the floor cleaning apparatus.

In a third aspect, a floor cleaning apparatus for cleaning a floor, the apparatus adapted to traverse a path of travel, comprises a housing, a chassis, a plurality of wheels by which the floor cleaning apparatus is adapted to move across the floor in a direction of travel, the direction of travel at least partially defining a front end, a back end, and first and second lateral sides of the floor cleaning apparatus, a motive device for moving the apparatus across the floor, a steering mechanism, a cleaning assembly for cleaning the floor, and a front sweeping system comprising a segmented brush holder comprising a first segment and a second segment, a plurality of brushes distributed along the length of the brush holder, and a biasing member attaching the first segment to the second segment, such that in operation the first segment is adapted to swing away from the second segment in response to encountering debris caught by the brushes.

In a fourth aspect, a method for cleaning a floor comprises providing a floor cleaning apparatus for cleaning a floor, the apparatus adapted to traverse a path of travel, comprising a housing, a chassis, a plurality of wheels by which the floor cleaning apparatus is adapted to move across the floor in a direction of travel, the direction of travel at least partially defining a front end, a back end, and first and second lateral sides of the floor cleaning apparatus, a motive device for moving the apparatus across the floor, a steering mechanism, a cleaning assembly for cleaning the floor, and a front sweeping system comprising a segmented brush holder comprising a first segment and a second segment, a plurality of brushes distributed along the length of the brush holder, and a biasing member attaching the first segment to the second segment, such that in operation the first segment is adapted to swing away from the second segment in response to encountering debris caught by the brushes, and navigating the apparatus across the floor while cleaning the floor such that debris is trapped by the plurality of brushes.

In a fifth aspect, a floor cleaning apparatus for cleaning a floor, the apparatus adapted to traverse a path of travel, comprises a housing, a chassis, a plurality of wheels by which the floor cleaning apparatus is adapted to move across the floor in a direction of travel, the direction of travel at least partially defining a front end, a back end, and first and second lateral sides of the floor cleaning apparatus, a motive device for moving the apparatus across the floor, a steering mechanism, a cleaning assembly for cleaning the floor, a squeegee assembly, and a pick-up system comprising a suction hose adapted to be connected to either the squeegee assembly or a debris collection bin, a suction motor, and a pick-up hose in communication with the collection bin.

In a sixth aspect, a method for cleaning a floor comprises providing a floor cleaning apparatus for cleaning a floor, the apparatus adapted to traverse a path of travel, comprising a housing, a chassis, a plurality of wheels by which the floor cleaning apparatus is adapted to move across the floor in a direction of travel, the direction of travel at least partially defining a front end, a back end, and first and second lateral sides of the floor cleaning apparatus, a motive device for moving the apparatus across the floor, a steering mechanism, a cleaning assembly for cleaning the floor, a squeegee assembly, and a pick-up system comprising a suction hose adapted to be connected to either the squeegee assembly or a debris collection bin, a suction motor, and a pick-up hose in communication with the collection bin, the method further comprising connecting the suction hose to the debris collection bin, activating the suction motor, and picking up debris from the floor through the pick-up hose and depositing the debris in the collection bin.

In another aspect, a floor cleaning apparatus for cleaning a floor comprises a housing, a chassis, a plurality of wheels by which the floor cleaning apparatus is adapted to move across the floor in a direction of travel, the direction of travel at least partially defining a front end, a back end, and first and second lateral sides of the floor cleaning apparatus, a motive device for moving the apparatus across the floor, a steering mechanism, a cleaning assembly for cleaning the floor, and a side sweeping system comprising a turntable having a central axis, a drive wheel, the drive wheel disposed in coaxial relationship with the turntable, a sweeper motive device for rotating the drive wheel, a plurality of brushes each having a central axis, the brushes distributed radially around the drive wheel and driven by rotation of the drive wheel, and a pivoting connector configured to enable the side sweeping system to pivot laterally away from a neutral position in response to contact with a vertical surface while at least one of the plurality of brushes maintains contact with the floor adjacent the vertical surface while the floor cleaning apparatus is in operation, and the brushes move debris that is disposed on the floor adjacent the vertical surface toward the front of the floor cleaning apparatus.

In one or more embodiments, the side sweeping system further comprises a plurality of edge rollers that are non-driven and extend laterally beyond the turntable, each edge roller mounted under or above the turntable and positioned above and co-axially aligned with a respective brush. The floor cleaning apparatus may include a main drive belt that transmits motive force from the sweeper motive device to the drive wheel while a plurality of brush drive belts transmit motive force from the drive wheel to each respective brush. The turntable may comprise a plurality of extension arms and an equal number of brushes, such as three extension arms, each extension arm comprising a central axis and each of the plurality of brushes is positioned under and in coaxial relationship with a respective extension arm. The brushes may be detachably connected to the turntable. The side sweeping system may further comprise one of a lifting device to lift the brushes above the floor and an agitator to shake the brushes. The turntable may further comprise a central turntable column that descends from the turntable, contacts the floor, and remains in contact with the floor as the floor cleaning apparatus moves across and cleans the floor. The side sweeping system may be supported in a vertical direction by a biasing member. The pivoting connector may comprise a deflection biasing member that urges the side sweeping system back to the neutral position when the side sweeping system pivots laterally away from the neutral position in response to contact with a vertical surface. In one or more embodiments, the turntable is not driven and is able to rotate independent of the drive wheel and brushes in response to the edge rollers contacting a vertical surface.

The cleaning assembly may comprise any of a motor-driven scrubbing brush, a scrubbing pad, a polisher, a vacuum system, a spray extractor, a reservoir for storing fresh cleaning liquid, a reservoir for storing spent cleaning liquid, a device for dispensing fresh cleaning liquid onto the floor, and a squeegee assembly for recovering spent cleaning liquid from the floor. The floor cleaning apparatus may further comprise a front sweeping system comprising a segmented brush holder comprising a first segment and a second segment, a plurality of front sweeper brushes distributed along the length of the brush holder, and a first biasing member attaching the first segment to the second segment, such that in operation the first segment can swing away from the second segment in response to debris caught by the front sweeper brushes. The floor cleaning apparatus may further comprise a pick-up system comprising a suction hose adapted to be connected to either a squeegee assembly or a debris collection bin, a suction motor, and a pick-up hose in communication with the collection bin.

DEFINITIONS

Figure 1:
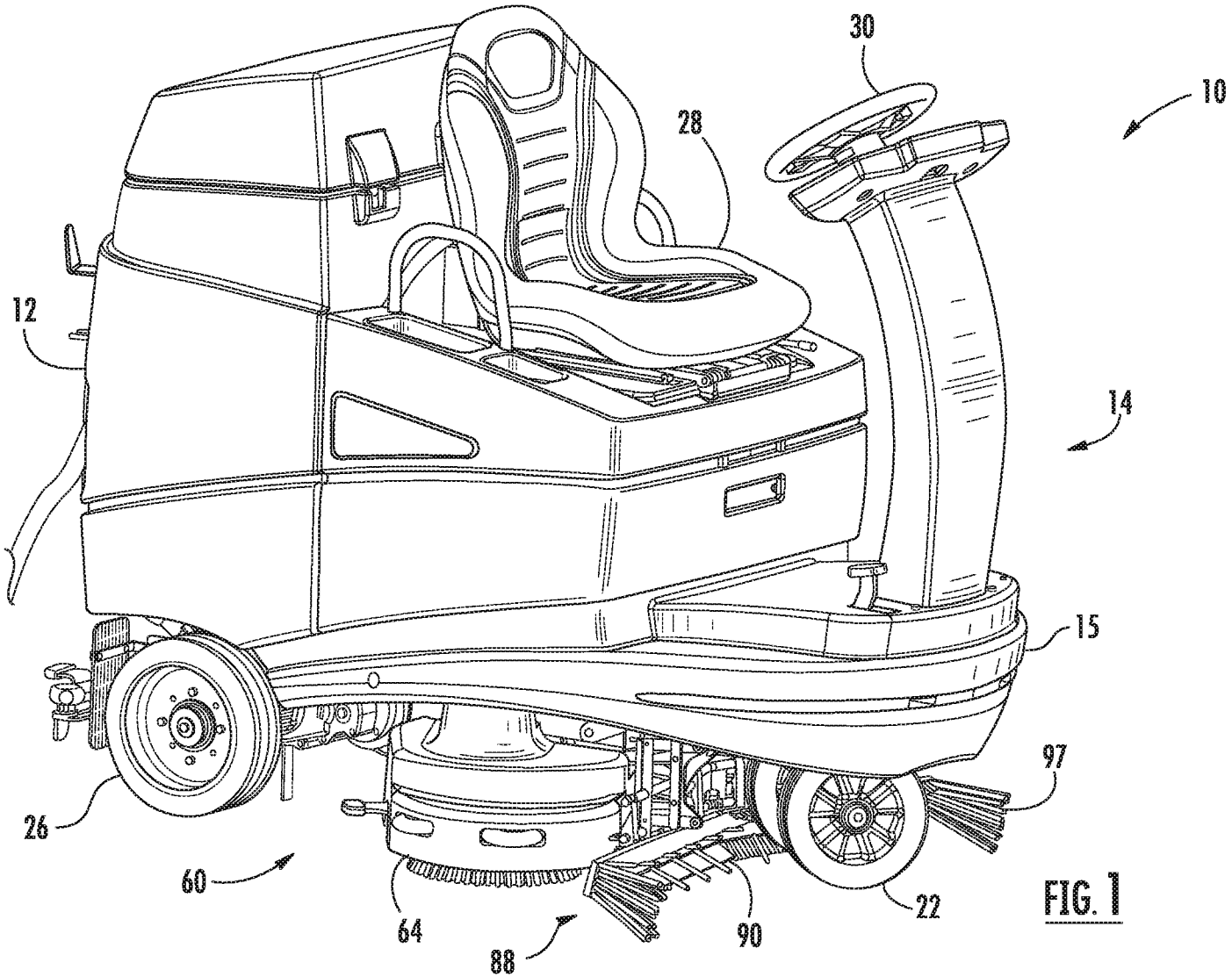
FIG. 1 is a perspective view of a floor cleaning apparatus.

"Cleaning" and the like herein refers to treating a floor; in one embodiment, this involves the use of a cleaning fluid and at least one brush, but alternatively or additionally refers to any of burnishing, polishing, vacuuming, sweeping, or brushing, with or without a cleaning fluid, or otherwise affecting the condition of, a floor.

DETAILED DESCRIPTION OF THE INVENTION

The drawings illustrate the configuration and operation of a floor cleaning apparatus 10 in accordance with the invention. Apparatus 10 includes a housing 12. In one embodiment, housing 12 includes a forward component 14.

Apparatus 10 is adapted to move across the floor in a direction of travel, the direction of travel at least partially defining, in one embodiment, a front end 15, a back end 19, and first and second lateral sides of the apparatus.

Apparatus 10 traverses the floor by means of a plurality of wheels. In one embodiment, the apparatus can include two front wheels, i.e. left front wheel 20 and right front wheel 22 connected by a front axle, and two rear wheels, i.e. left rear wheel 24 and right rear wheel 26 connected by a rear axle. The two front wheels can be spaced apart a distance equal to the distance between the two rear wheels. Alternatively, the front wheels can be spaced apart a distance greater than, or less than, the distance between the two rear wheels. Alternatively, the apparatus can have a single front wheel and a pair of rear wheels; or a pair of front wheels and a single rear wheel. The apparatus includes at least one drive wheel. Any or all of the wheels can be drive wheels, and the apparatus can include one or more caster or free wheels. The plurality of wheels by which the floor cleaning apparatus is adapted to move across the floor in a direction of travel, can include one or more drive wheels, such as a pair of driving wheels for moving the body, a motor, such as an electric motor, for directly or indirectly driving the wheel or wheels, and steering and speed control members for operating the driving motor. Steering may either be manual or by way of differentiated control of individual wheel speeds.

Apparatus 10 includes a motive device (such as at least one motor, not visible) for moving the apparatus across the floor. Drive wheels can be connected to and powered by electric motors indirectly by e.g. a belt or a chain, but other connections can also be used, e.g., the wheels can be individually powered by hub motors.

Apparatus 10 includes a steering mechanism 30, which can include a conventional steering wheel. Instead of a steering wheel, mechanism 30 can have other configurations, for example, can comprise two hand gears or levers, one for each front wheel, which are pulled forward or backward, etc. Steering mechanism 30 also includes the appropriate steering linkage to operationally couple e.g. the steering wheel to the wheels used to guide the path of the floor cleaning apparatus; as well as a steering housing to accommodate the steering linkage. Steering mechanism 30 can also include a user interface or dashboard and may simply comprise a handlebar to maneuver apparatus 10. Steering can be controlled by the front wheel or wheels, or by the back wheel or wheels.

Apparatus 10 includes a cleaning assembly 60 for cleaning the floor.

Cleaning assembly 60 includes in one embodiment one or more brush assemblies including, e.g. a circular brush or brushes, suitably powered by an electric motor or other motive device to turn the brushes when the apparatus is in cleaning mode. Cleaning assembly 60 may also include other types of brushes such as non-circular, vibrating or oscillating brushes. In one embodiment, cleaning assembly 60 includes a left brush assembly 62 and a right brush assembly 64. In one embodiment, these brushes operate to rotate in opposite directions so as to maximize the scrubbing function while moving soil and spent liquid toward a region under the machine where a squeegee assembly 85 can pick up the spent liquid from the floor. In one embodiment, the brush assemblies 62 and 64 are located at or near the front of the machine. After a cleaning step using the brushes, it is desirable to wipe up liquid that remains on the floor surface, as well as remove the imprint of any cleaning apparatus wheel tracks. These operations are commonly performed by the squeegee assembly 85 that is located at or near the back of the cleaning apparatus. The squeegee assembly 85 can typically be raised or lowered relative to the chassis 40 of the machine e.g. by using a linking unit or other suitable device.

A straight, V-shaped, or arced squeegee assembly 85 can be used to remove liquid from the floor. Alternatively, a W-shaped squeegee assembly, as disclosed e.g. in U.S. Pat. No. 7,950,106 B2 (Oberhaensli et al.) can be used. U.S. Pat. No. 7,950,106 B2 is incorporated herein by reference in its entirety. A squeegee assembly 85 typically includes blades that engage the floor surface in a wiping action to assist in picking up liquid from the floor. A suction unit is used to apply suction to the liquid to remove it from the floor.

Cleaning unit can include e.g. two treatment elements, each element equipped with a cleaning device and eccentrically driven, such as shown in U.S. Pat. No. 8,201,296 B2 (Mayer), incorporated herein by reference in its entirety.

Figure 16:
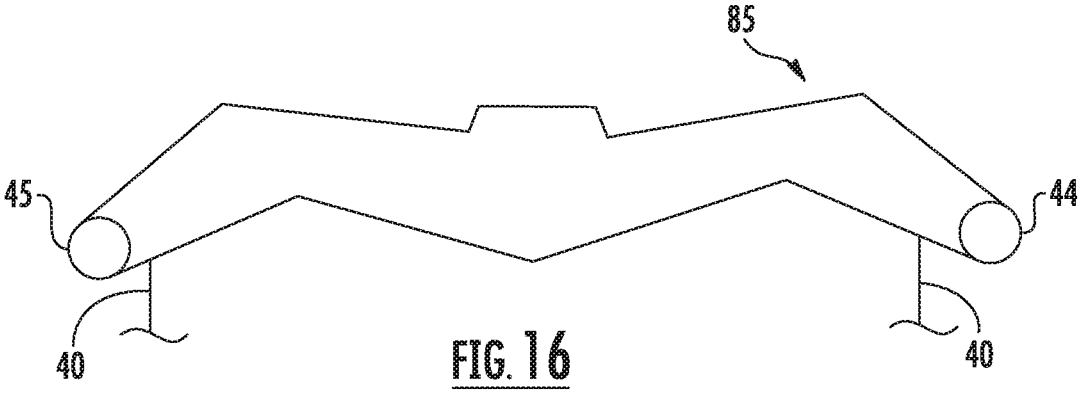
FIG. 16 is a schematic top plan view of a squeegee assembly.

In one embodiment, squeegee assembly 85 can include respective edge wheels 44 and 45 (see FIGS. 6 and 16) to assist in navigating the apparatus 10 adjacent walls and other obstacles in a room or space in which the apparatus 10 is being used.

The brushes can be of any suitable material, size, shape, and bristle density and pattern. In one embodiment, the brushes of brush assembly 62 and 64 are offset from each other with respect to the longitudinal centerline of the floor cleaning apparatus; i.e. a brush centerline running through the center of the two brushes is in one embodiment not perpendicular to the longitudinal center line of the apparatus, or is not transverse to the direction of travel of the apparatus during operation. Such an arrangement minimizes the lateral extent of the cleaning assembly 60 to control the lateral extent of the apparatus 10, and so that the apparatus 10 can pass through relatively narrow slots, spaces or passageways.

Alternatively or additionally, the cleaning unit 60 can comprise a brush assembly 62 and/or 64 in combination with a dispenser for dispensing a cleaning solution onto the floor; a burnishing device; a polishing device; a sweeping device; a vacuum device; or any suitable combination of the above.

In one embodiment, brush assembly 62 and 64 can include respective edge wheels 42 and 43 (see FIG. 6) to assist in navigating the apparatus 10 adjacent walls and other obstacles in a room or space in which the apparatus 10 is being used.

Apparatus 10 includes in one embodiment an operator seat 28, situated between the front end 15 and the back end 19, and adapted to accommodate a human operator.

Figure 3:
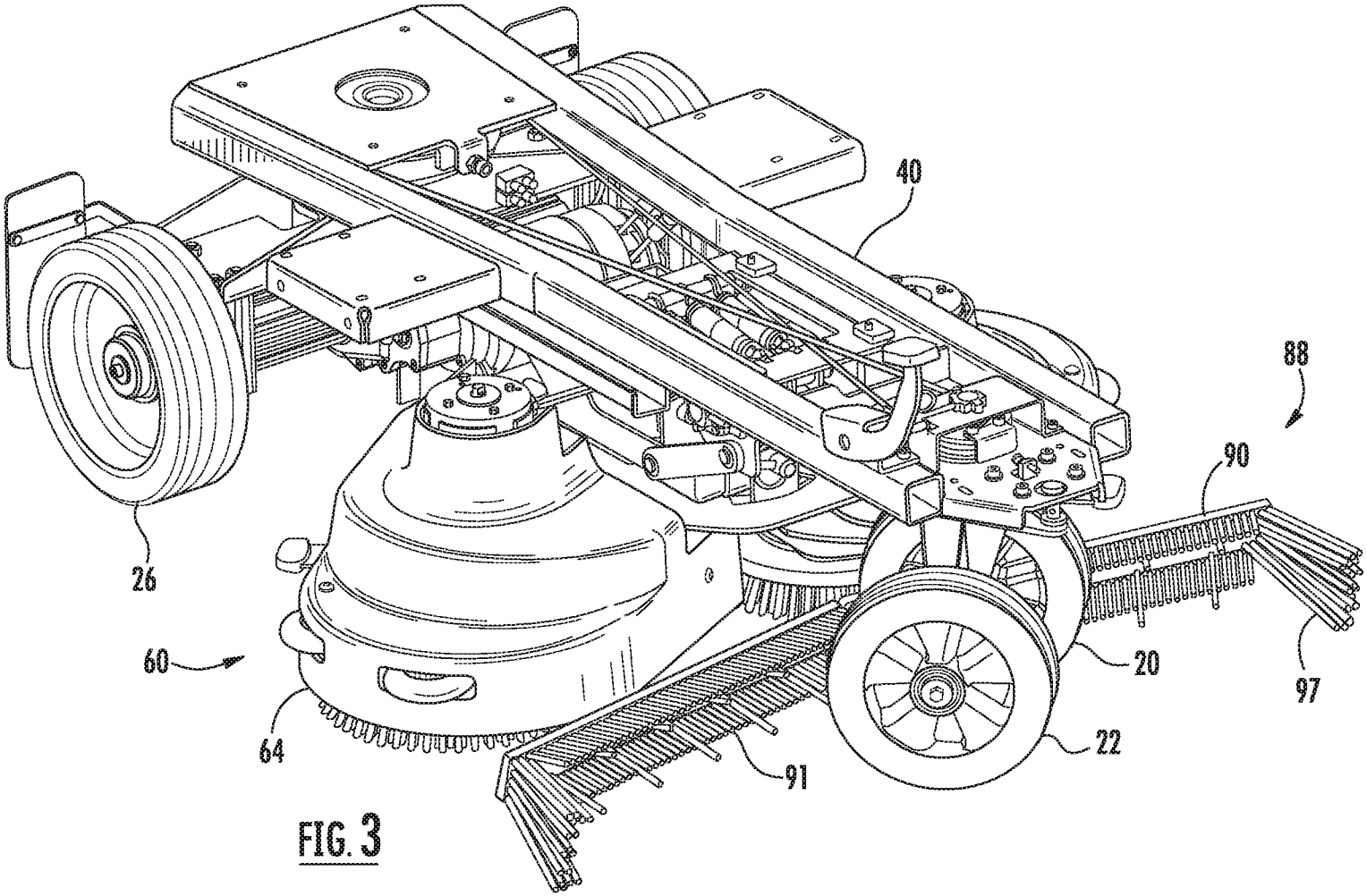
FIG. 3 is a perspective view of a portion of a floor cleaning apparatus.
Figure 4:
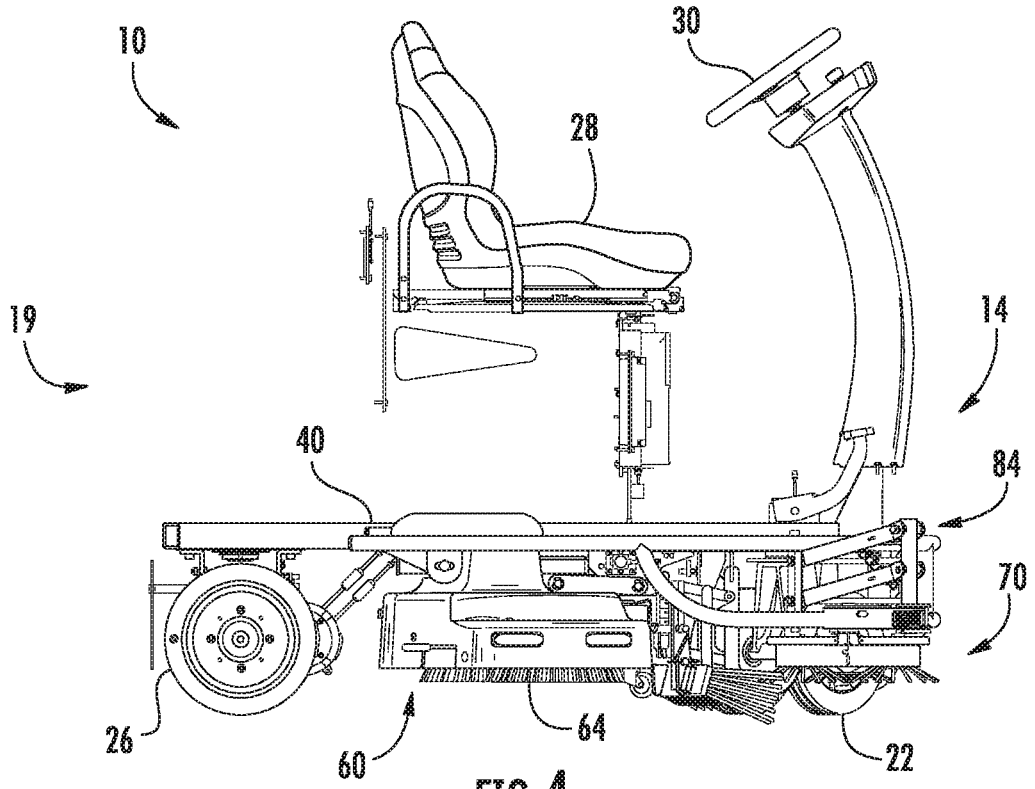
FIG. 4 is a side elevational view of a portion of a floor cleaning apparatus.
Figure 5:
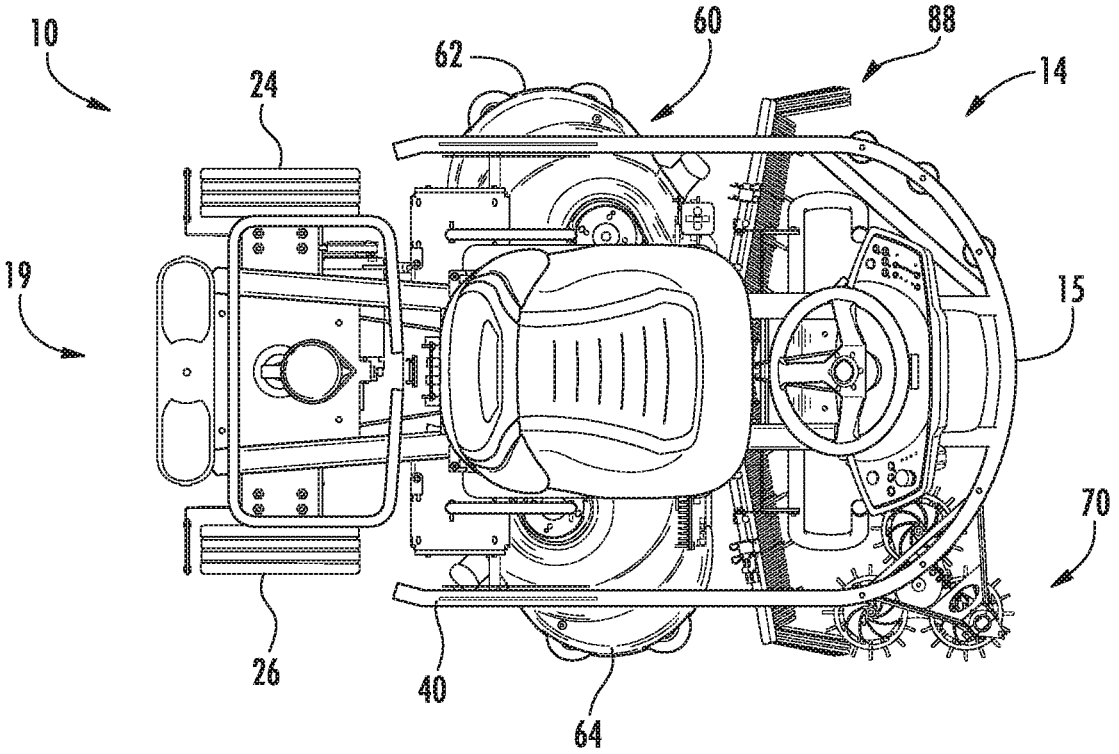
FIG. 5 is a top plan view of a portion of a floor cleaning apparatus.

Apparatus 10 includes in one embodiment a chassis 40 (see FIG. 3) that provides a supporting frame for the housing and other components of apparatus 10.

In one embodiment, squeegee assembly 85 is located rearward of any mechanism for dosing and dispensing a cleaning fluid, and rearward of any cleaning brushes if present. The housing 12 in one embodiment has a forward component 14 that can be used to house functional elements such as the steering mechanism 30, and to serve as protection for the operator.

A. Side Sweeping System

Floor cleaning apparatus 10 includes in one embodiment a side sweeping system 70. System 70 (see FIGS. 8 and 9) provides a mechanism for sweeping debris located at or near e.g. a straight wall, corner wall, obstacle, or other vertical surface toward the front of the cleaning path of apparatus 10. This debris can then be picked up manually or by alternative systems disclosed herein.

Side sweeping system 70 includes a turntable 71 having a central axis 78; a drive wheel 87 disposed in coaxial relationship with the turntable 71; a sweeper motive device 75 (see FIG. 17) in operative communication with drive wheel 87; a plurality of driven brushes 74 each having a central axis 79, the brushes distributed radially around, and adapted to be driven by rotation of, drive wheel 87; and a pivoting connector 72 configured to enable side sweeping system 70 to pivot laterally in response to contact with a wall while at least one of the plurality of driven brushes 74 maintains contact with the wall while floor cleaning apparatus 10 is in operation, and the brushes 74 move debris that is disposed on the floor adjacent the wall toward the front of the floor cleaning apparatus.

In one embodiment, brushes 74 have bristles that are highly flexible and only lightly touch the floor so that they can adapt to walls and corners.

In one embodiment, sweeper motive device 75 can comprise an electric motor.

In one embodiment, side sweeping system 70 also includes a plurality of non-driven edge rollers 73, each edge roller mounted under or above the turntable and positioned above and coaxially aligned with a respective brush. Edge rollers 73 can assist in navigating the apparatus 10 and side sweeping system 70 as they move adjacent walls and other obstacles in a room or space in which the apparatus 10 is being used.

Motive force can be transmitted from sweeper motive device 75 to drive wheel 87 by any suitable mechanism, such as for example by a main drive belt 76.

Figure 21:
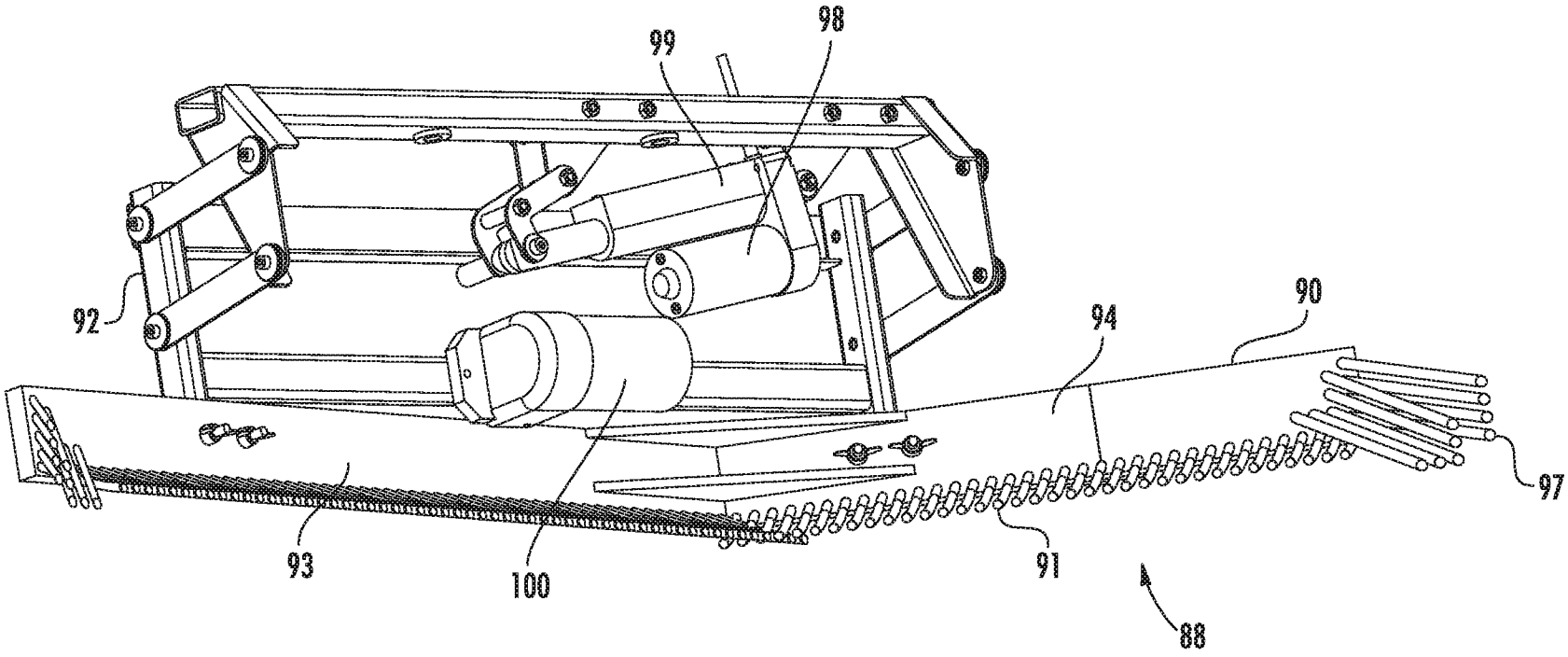
FIG. 21 is a perspective view of an upper side of one embodiment of a front sweeping assembly.

Motive force can in turn be transmitted from drive wheel 87 to each respective brush 74 by any suitable mechanism, such as for example by a brush drive belt 77 (see FIG. 21).

Figure 12:
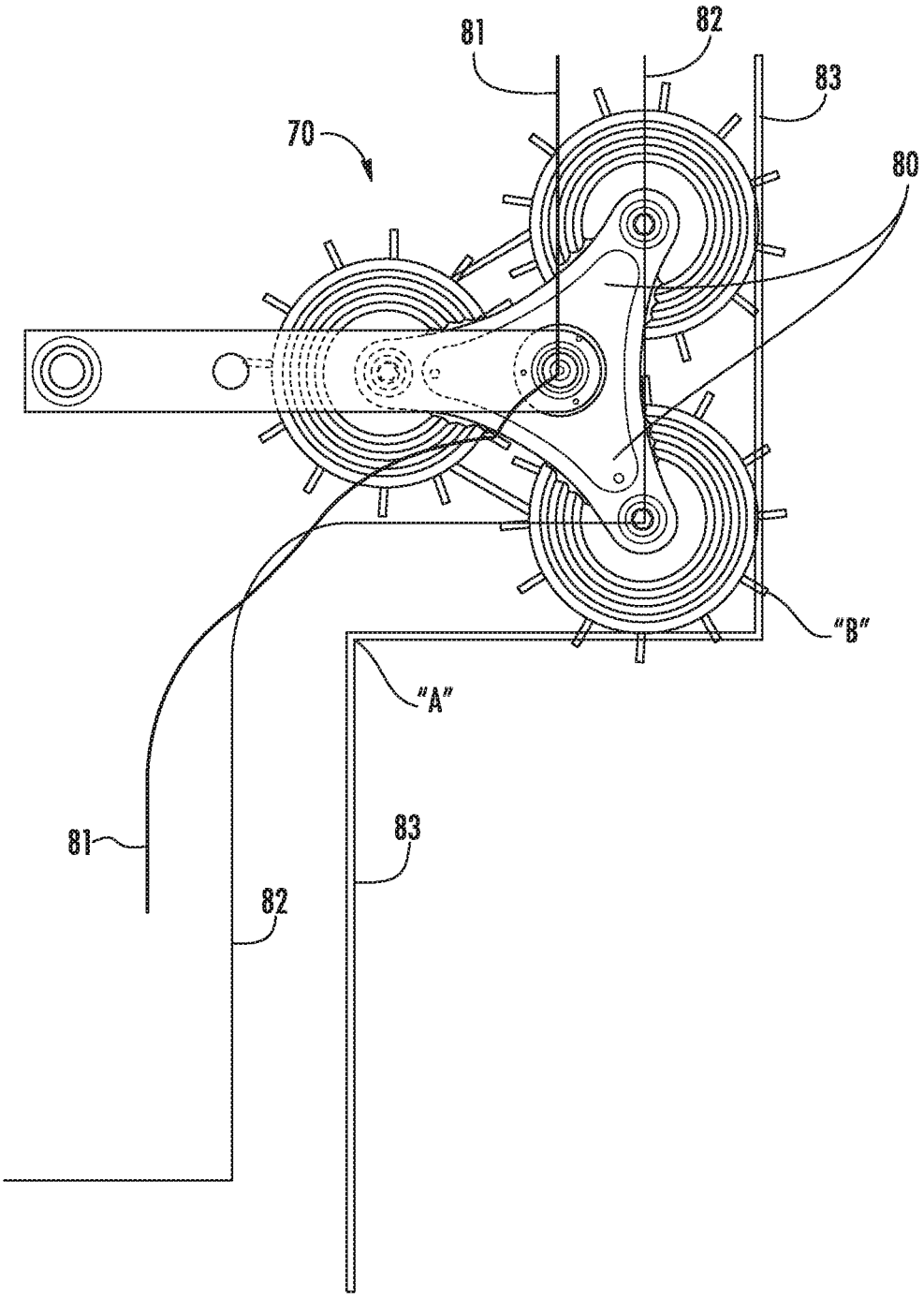
FIG. 12 is a schematic top plan view of a side sweeping assembly at a fifth position.

In one embodiment, turntable 71 includes a plurality of extension arms 80 (see FIG. 12). Any suitable number of extension arms can be utilized, and typically the number of extension arms 80 will correlate with the number of brushes 74 and, if present, edge rollers 73 (see FIG. 8). In one embodiment, turntable 71 has three extension arms 80. In one embodiment, extension arms 80 are equally spaced around the turntable.

Any suitable number of brushes 74 can be utilized. In one embodiment, side sweeping system 70 comprises three driven brushes 74. In one embodiment, the plurality of driven brushes 74 are equally spaced from each other.

In one embodiment, each of extension arms 80 comprises a central axis that coincides with a respective brush axis 79, and each of the plurality of brushes 74 is positioned under and in coaxial relationship with a respective extension arm 80.

In one embodiment, each non-driven edge rollers 73 is positioned between, and in coaxial relationship with, a respective extension arm 80 and brush 74.

In one embodiment, the turntable 71 is not driven. In a second embodiment, the turntable is driven.

Cleaning assembly 60 comprises any one or more of a motor-driven scrubbing brush, a scrubbing pad, a polisher, a vacuum system, a spray extractor, a reservoir for storing fresh cleaning liquid, a reservoir for storing spent cleaning liquid, a device for dispensing fresh cleaning liquid onto the floor, and a squeegee assembly for recovering spent cleaning liquid from the floor.

Figure 2:
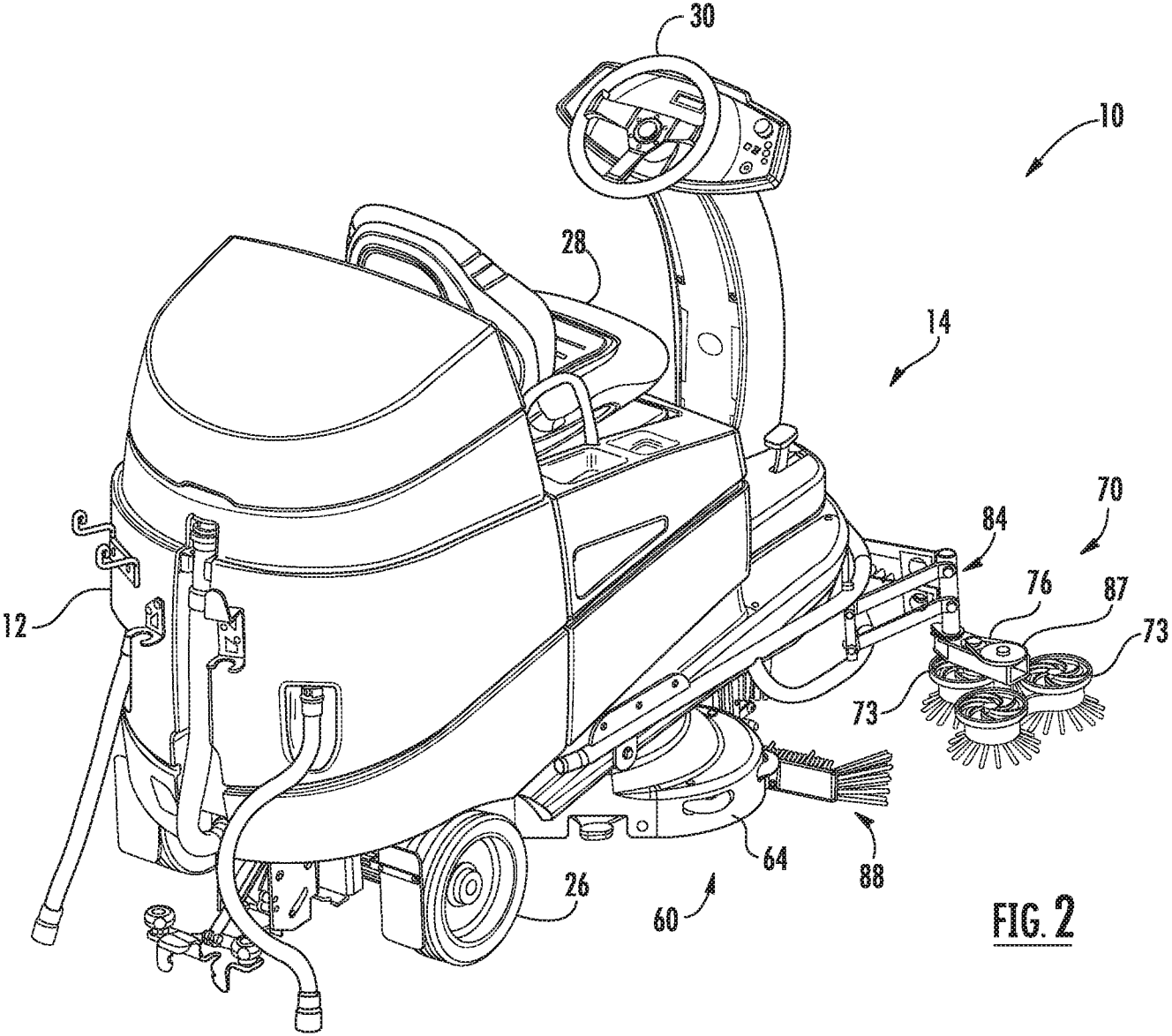
FIG. 2 is another perspective view of a floor cleaning apparatus.

Side sweeping system 70 can be operated independently of cleaning assembly 60, and independently of a front sweeping system 88 (if present). Alternatively, side sweeping system 70 can be operated while the cleaning assembly 60 is activated, and/or in combination with front sweeping system 88. Side sweeping system 70 can be operated by the operator from a dashboard, and can be lifted out of the way either manually or mechanically, e.g by a mechanical motor-driven system. For instance, FIG. 2 shows a lifting device 84 that permits vertical lifting of the side sweeping system 70 as needed during non-cleaning travel or storage of the floor cleaning apparatus 10. In one embodiment, the lifting device 84 includes a four-bar linkage. Alternatively, the lifting device 84 may include a telescoping hydraulic or pneumatic rod.

Although side sweeping system 70 is illustrated in a right-handed configuration, those skilled in the art will appreciate that the same system can be used in a left-handed configuration, with system 70 projecting from the front left side of apparatus 10, and by operating apparatus 10 along e.g. a left perimeter wall.

Figure 19:
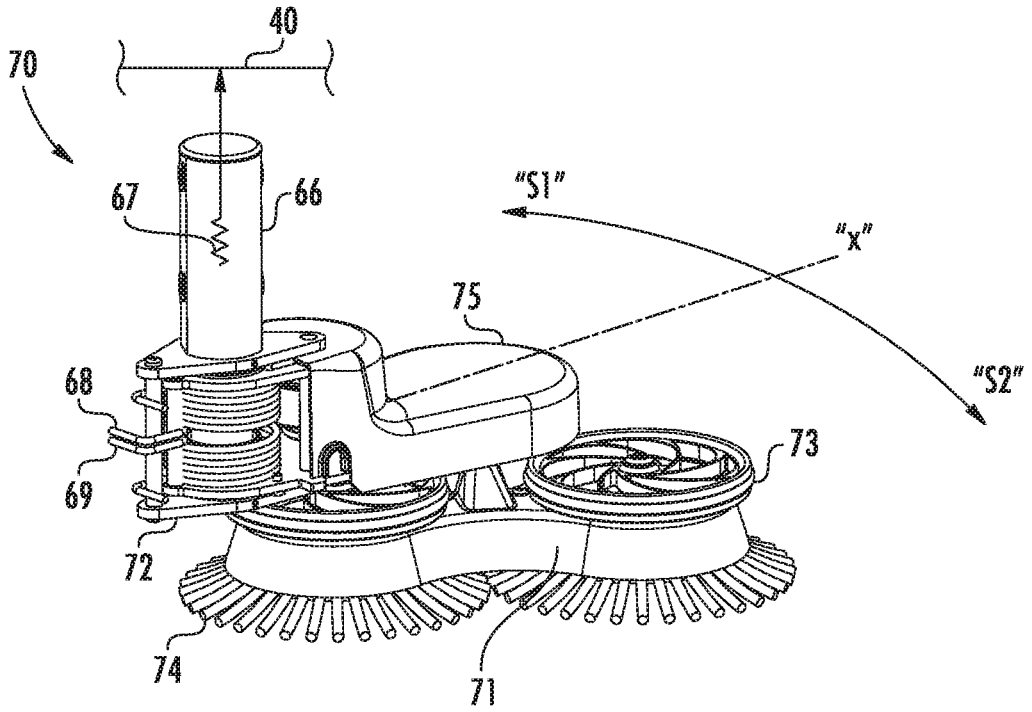
FIG. 19 is a perspective view of an upper side of one embodiment of a side sweeping assembly.

One embodiment of a biasing mechanism is illustrated in FIG. 19 shows a side sweeping system 70 that is schematically attached to chassis 40 at support arm 66. The support arm 66 may be coupled to the chassis 40 in a number of different ways, including for example a four-bar linkage as shown in FIG. 2 or as part of a telescoping arrangement. In some embodiments, a vertical biasing member 67 may be used as part of the coupling arrangement to help support the weight of the side sweeping system 70. A vertical biasing member 70 may assist in keeping the brushes 74 suspended above the surface to be cleaned for optimal sweeping action. The vertical biasing member 70 may be implemented as a spring, such as a coil spring, torsion spring, or a leaf spring.

In various embodiments, the side sweeping system 70 extends laterally out from the side of floor cleaning unit 10. In this configuration, it is possible that the side sweeping system may contact walls, desks, garbage receptacles and the like. To minimize potential damage and maintain cleaning effectiveness, the pivoting connector 72 may deflect in one or more directions if edge rollers 73 come into contact with other objects. In the illustrated embodiment, pivoting connector 72 is able to pivot about support arm 66 from a neutral position defined by centerline "X" in a first direction shown by arrow "S1" and a second direction shown by arrow "S2". One or more deflection biasing members 68, 69 are coupled to the pivoting connector 72 and work to pull the pivoting connector 72 back to the neutral position "X"

whenever the pivoting connector 72 deflects in either direction "S1" or "S2". In one embodiment, the deflection biasing members 68, 69 are oppositely configured so that each applies a greater biasing force when the pivoting connector 72 is deflected in one direction versus the other. The deflection biasing members 68, 69 may be implemented as a spring, such as a coil spring, torsion spring, or a leaf spring.

Figure 20:
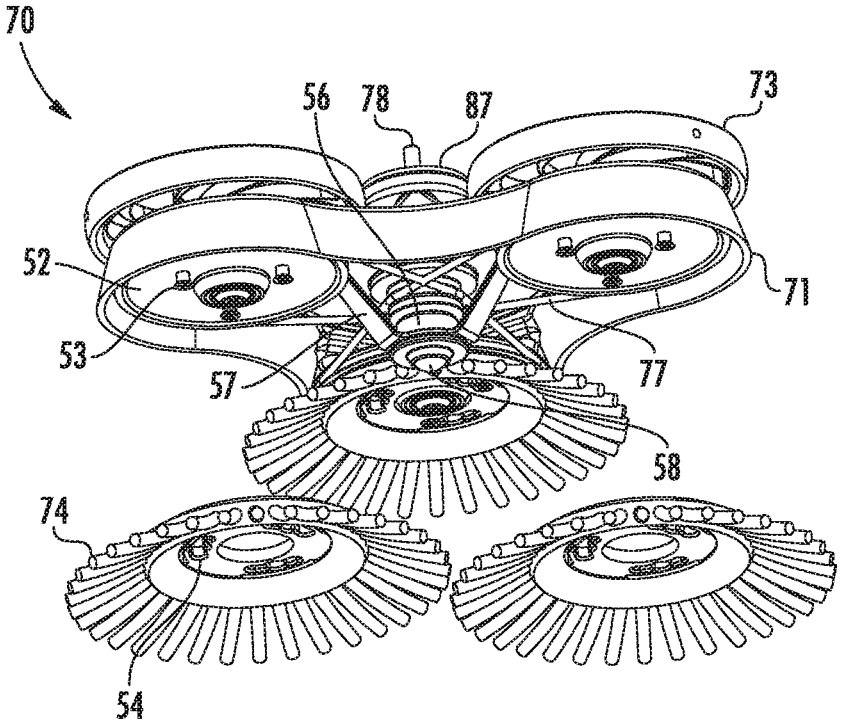
FIG. 20 is a perspective view of an under side of one embodiment of a side sweeping assembly.

In one embodiment of a side sweeping system 70, as illustrated in FIG. 20, the brushes 74 are detachably replaceable units. From time to time, the brushes 74 may wear or become excessively soiled. To permit quick replacement, the brushes 74 can be attached by brush fasteners 53 to a brush base 52. Each brush base 52 is rotated by brush drive belts 77 that are driven by drive wheel 87. Each brush 74 shown in FIG. 20 includes a mounting aperture 54 that permits coupling of the brush 74 to the brush base 52 via brush fasteners 53. The mounting apertures 54 may be configured as slots that are generally narrower than the heads of brush fasteners 53. However, the slots may have an enlarged opening that is larger than the head of brush fasteners 53 to permit easy attachment and removal of the brush 74.

FIG. 20 also shows an embodiment of side sweeping system 70 with another feature that helps to keep the brushes 74 suspended above the surface to be cleaned for optimal sweeping action. In the illustrated embodiment, a central turntable column 56 that is aligned with the turntable central axis 78 descends from turntable 71. The central turntable column 56 supports the weight of the side sweeping system 70. Support columns 57 provide additional structural support and also descend from turntable 71, but from locations closer to each individual brush 74 and attach to a lower portion of the central turntable column 56. A ball transfer unit 58 is attached to the bottom of the central turntable column 56 and makes contact with the surface to be cleaned, thus supporting the weight of the turntable 71 and suspending the brushes 74 above the surface to be cleaned for optimal sweeping action. The ball transfer unit 58, sometimes referred to as a roller ball or omnidirectional caster, includes a constrained ball that is free to rotate in any direction, and which allows the turntable 71 to glide along the surface to be cleaned. The constrained ball within the ball transfer unit 58 is sometimes constructed of metal, plastic or rubber and preferably is fabricated with a non-scratching, non-marring material. In alternative embodiments, a gliding pad, a felt pad, or other low-friction material may be used at the bottom of the central turntable column 56 to support the weight of the turntable 71 while still allowing the turntable 71 to glide across a surface to be cleaned. In another embodiment, the vertical biasing member 67 and the ball transfer unit 58 can be combined into a single spring loaded ball transfer unit of the type available from Omnitrack, Ltd.

B. Front Sweeping System

Floor cleaning apparatus 10 includes in one embodiment a front sweeping system 88. System 88 provides a mechanism for collecting debris located generally in front of, i.e. in the cleaning path of apparatus 10.

Figure 14:
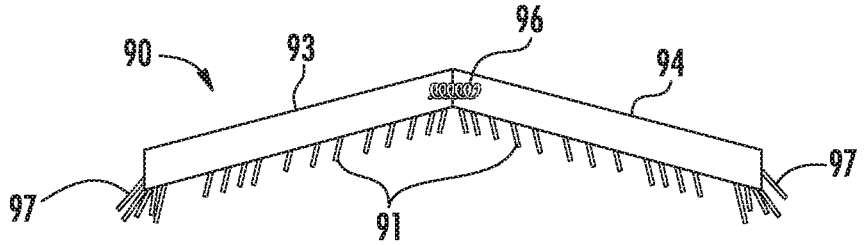
FIG. 14 is a schematic view of a front sweeping assembly.

In an embodiment illustrated in FIG. 14, front sweeping system 88 includes a segmented brush holder 90 comprising in one embodiment a right front sweeper segment 93 and a left front sweeper segment 94, a plurality of brushes 91 distributed along the length of brush holder 90, and a first biasing member 96 attaching the right front sweeper segment 93 to the left front sweeper segment 94, such that in operation the right front sweeper segment 93 can swing away from the left front sweeper segment 94 in response to encountering debris caught by the brushes.

Figure 15:
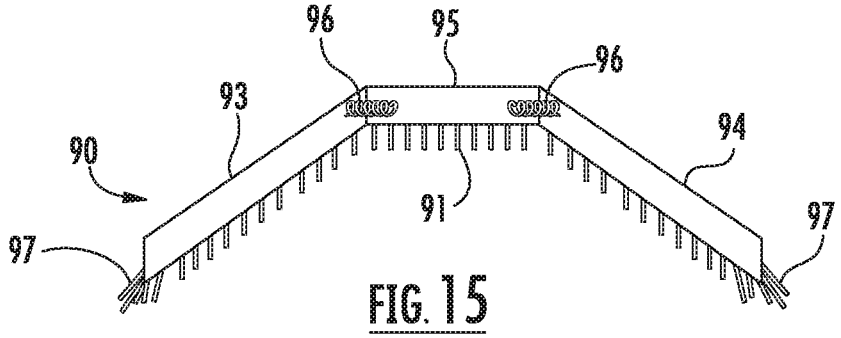
FIG. 15 is a schematic view of a front sweeping assembly in an alternative embodiment.

In another embodiment illustrated in FIG. 15, front sweeping system 88 includes a third, central front sweeper segment 95 disposed between the right front sweeper segment 93 and the left front sweeper segment 94; a first biasing member 96 attaching the central front sweeper segment 95 to the right front sweeper segment 93; and a second biasing member 96 attaching the central front sweeper segment 95 to the left front sweeper segment 94, such that in operation the right and/or left front sweeper segments 93, 94 can swing away from the central front sweeper segment 95 in response to debris caught by the brushes.

Figure 18:
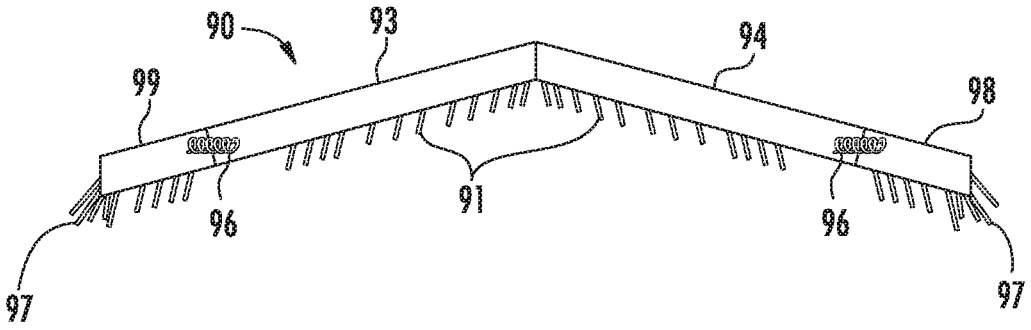
FIG. 18 is a schematic view of a front sweeping assembly in an alternative embodiment.

In yet another embodiment (see FIG. 18), front sweeping system 88 includes two front sweeper segments 93 and 94, that together form a "V" shape, adapted to collect debris in a manner such that the debris is held in the central portion of the "V" while apparatus 10 is making a right or left hand turn. Attached to front sweeper segments 93 and 94 are peripheral sweeper segments 99 and 98 respectively, attached by respective biasing members 96. In operation, peripheral sweeper segment 99 can swing away from sweeper segment 93 in response to debris caught by the brushes. Likewise, in operation, peripheral sweeper segment 98 can swing away from sweeper segment 94 in response to debris caught by the brushes. In other embodiments, front sweeping system 88 includes only sweeper segments 93, 94, and 99, with a biasing member 96 attaching segments 93 and 99; or only sweeper segments 93, 94 and 98, with a biasing member 96 attaching segments 94 and 98. Biasing members 96 can in one embodiment comprise a spring.

Brushes 91 can be of any suitable length and distribution, and in one embodiment can as shown in the drawings include longer bristles 97 along the outer periphery of brush holder 90. The longer bristles 97 help to prevent debris from leaving the area of the front sweeping system 88 while apparatus 10 is making a right or left hand turn.

It should be noted that the front sweeping system 88 of the invention may eliminate the need for typical cylindrical brushes and a bin to collect debris, since system 88 may be configured to collect, and not pick up the debris.

Optionally, front sweeping system 88 can include any of a brush housing; a mechanism such as lifting device 92 (see FIG. 17) to lift brush holder 90 either manually or mechanically using a motor; and a mechanism to shake the brushes to remove debris. For example, FIG. 21 shows an embodiment of a front sweeping system 88 that includes a lifting device 92 and an agitator 100 to shake the brushes. Agitator 100 may include a motor that moves an associated mass in a linear or eccentric manner to shake the entire brush holder 90. In one embodiment, the lifting device 92 includes a lifting motor 98 and linear actuator 99 that cooperate with a four-bar linkage to lift the brush holder 90 as needed during non-cleaning travel or storage of the floor cleaning apparatus 10. Other motorized or manual systems known in the art can be implemented to lift the brush holder 90. A similar lifting motor 98 and linear actuator 99 may be used with offset lifting device 84 to lift side sweeping system 70. In some embodiments, the side sweeping system 70 includes a similar agitator 100.

Front sweeping system 88 can be positioned at any suitable location on apparatus 10, and where a squeegee assembly 85 is present, is beneficially placed in front of the squeegee assembly 85. This arrangement provides the benefit of significantly reducing the amount of debris to which the blades of the squeegee assembly 85 are exposed in operation. In this arrangement, front sweeping system 88 can optionally be positioned behind cleaning assembly 60, but in front of squeegee assembly 85.

Front sweeping system 88 finds beneficial utility when used in conjunction with side sweeping system 70. Thus, in one embodiment apparatus 10 can be operated such that the side sweeping system 70 is used to move debris from areas at or near perimeter walls of a room or space, toward the front of the cleaning path of the apparatus; and then the front sweeping system can be used to trap the debris so moved. Thereafter, the debris can be picked up manually or by using a pick-up system 35 described in greater detail below.

Alternatively, side sweeping system 70 can be employed without the use of either the the front sweeping system 88 or the pick-up system 35. In still another alternative, front sweeping system 88 can be used in conjunction with pick-up system 35, and without use of side sweeping system 70. Thus, any of side sweeping system 70, front sweeping system 88, and pick-up system 35 can be used alone or in any suitable combination.

C. Pick-Up System

Floor cleaning apparatus 10 includes in one embodiment a pick-up system 35. System 35 provides a mechanism for picking up debris located generally in front of, i.e. in the cleaning path of apparatus 10. Pick-up system 35 includes a suction hose 37 adapted to be connected to either a squeegee assembly 85 or a debris collection bin 38, a suction motor 36, the debris collection bin 38, and a pick-up hose 39 in communication with the collection bin 38. Debris collection bin 38 can be located on the outside of housing 12, at any suitable location, or alternatively within housing 12.

Optionally, a hand-operated or motor-operated valve positioned on apparatus 10 can activate the suction function of the suction hose 37 by switching the power of the suction motor from the squeegee assembly 85 (to which the suction motor is operationally connected in one operational mode) to the pick-up hose 39.

Optionally, a bar or handle 51 can be used to guide the suction hose for picking up debris, without the need for the human operator to leave the operating (standing/sitting/walking) position.

D. Side Sweeping System Operation

Figure 6:
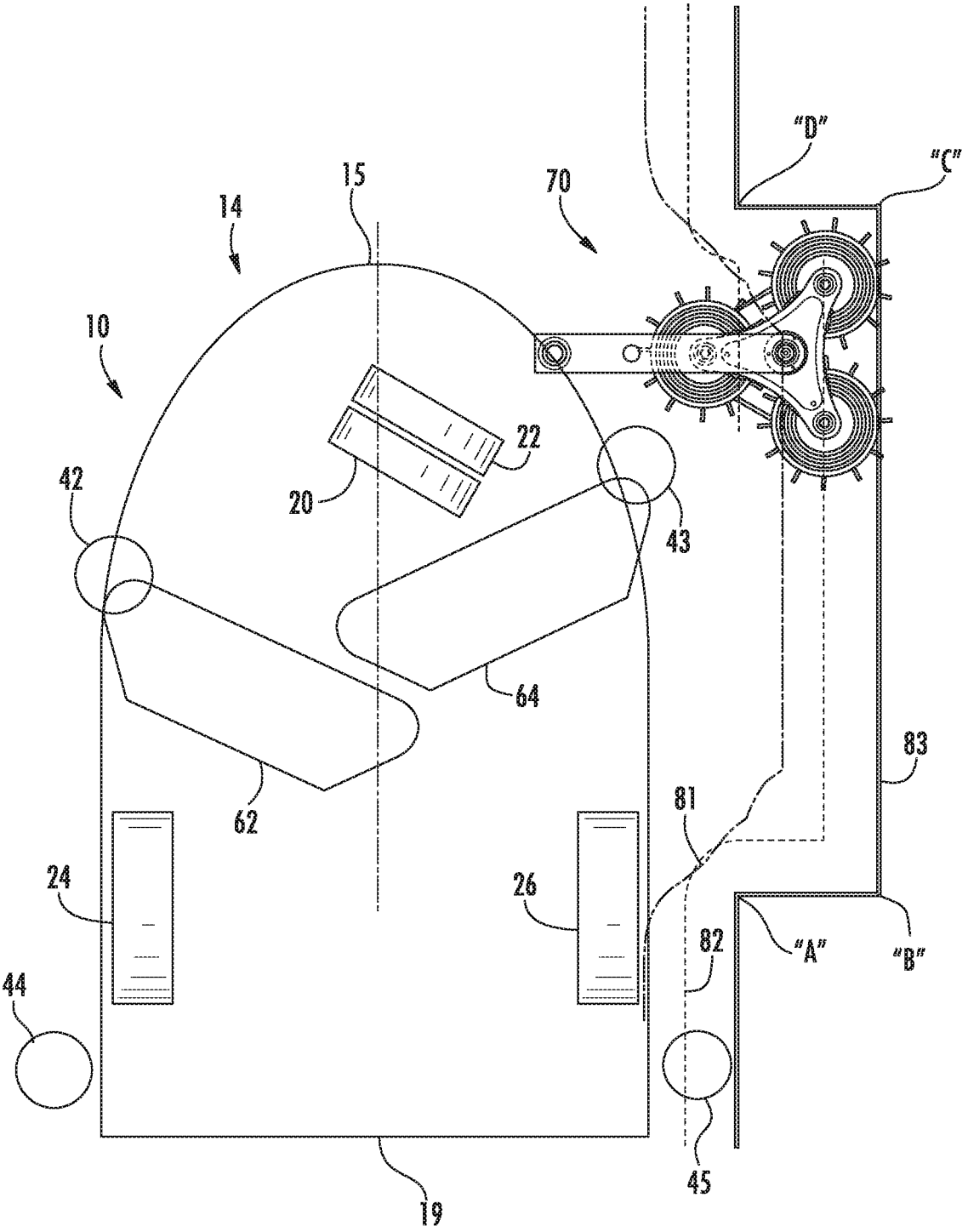
FIG. 6 is a schematic top plan view of a floor cleaning apparatus at a first position.
Figure 7:
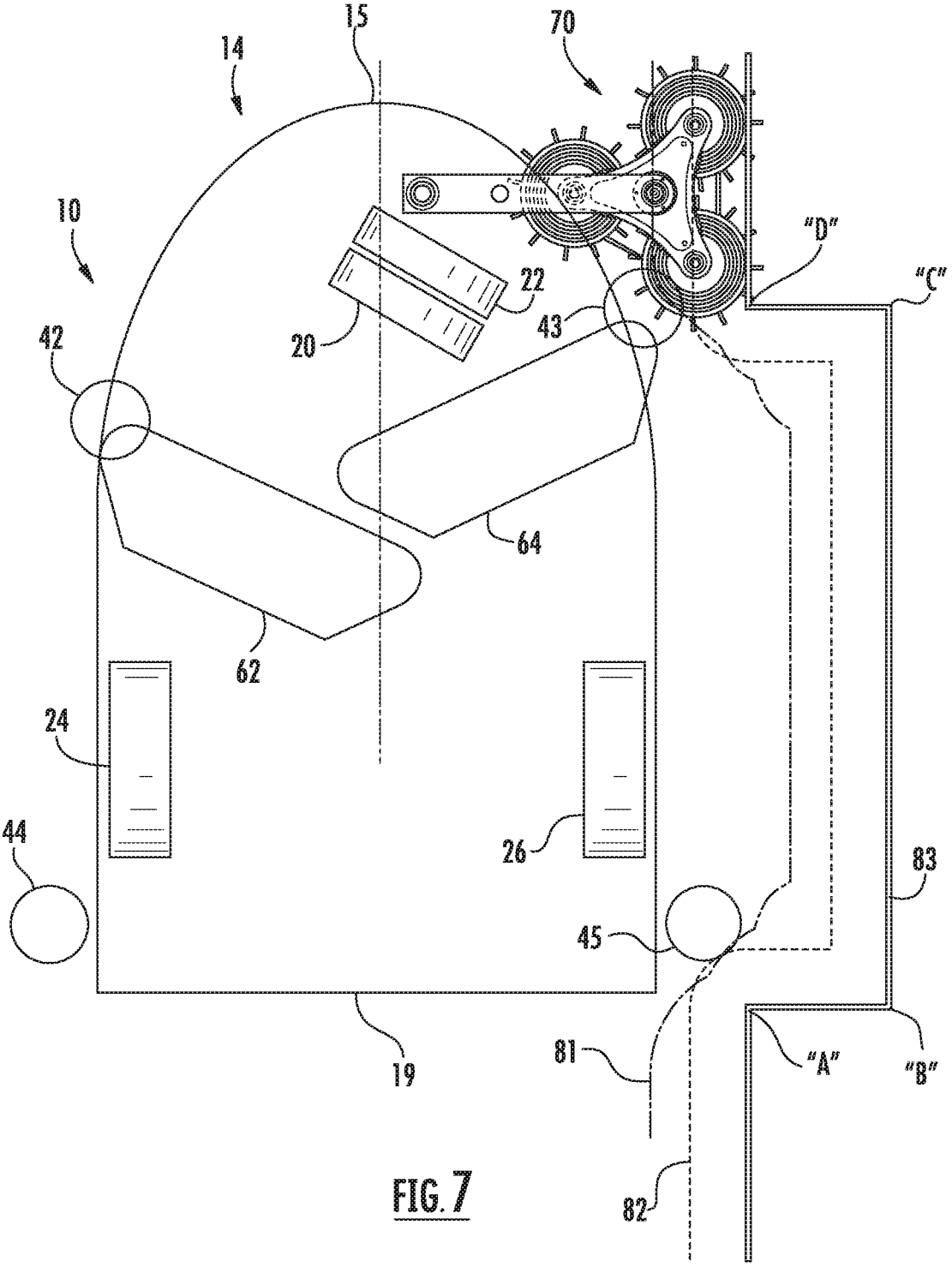
FIG. 7 is a schematic top plan view of a floor cleaning apparatus at a second position.

Referring especially to FIGS. 6 and 7, a schematic top plan view of a floor cleaning apparatus 10 is shown in the environment of a floor adjacent a wall 83 having an inset, i.e. having corners "A", "B", "C", and "D". Apparatus 10 is shown at a first position (FIG. 6) and a second position (FIG. 7), with the second position being advanced from the first position as apparatus 10 advances across the floor in a cleaning mode.

In FIGS. 6 and 7, as well as FIGS. 8 to 13 to be disclosed in further detail herein, reference numeral 81 represents the travel path of turntable central axis 78, and reference numeral 82 represents the travel path of proximal brush axis 79, that is, the axis 79 of the brush or brushes 74 (usually two brushes and sometimes only one brush) in closest proximity to, and in contact with wall 83 or a corner thereof.

It can be seen that in FIG. 6, side sweeping system 70, as it advances in a cleaning mode, is positioned such that two of the brushes 74 are brushing up against wall 83. Brushes 74 can each be rotated in either a clockwise or counterclockwise direction, but optimally in a direction that will maximize the movement of debris, encountered on the floor adjacent wall 83, in a direction that places the debris in front of or in the cleaning path of apparatus 10. FIG. 7 shows the same apparatus 10 now advanced to a position in which side sweeping system 70 has gone around corner "D", and in which two of the brushes 74 (not the same two brushes as in FIG. 6) are brushing up against wall 83. Thus, at all or substantially all positions in a floor cleaning campaign using side sweeping system 70, when apparatus 10 is operated in proximity to a wall, at least one and usually two brushes will maintain contact with the floor adjacent wall 83 and/or with wall 83. This action is enabled by a pivoting connector 72 that can be biased, by a suitable mechanism such as springs 68, 69 (FIG. 19), so as to bias system 70 and thus brushes 74 toward a wall 83, or other corner or obstacle to assure sweeping of the floor adjacent the wall or obstacle, but such that system 70 gives way when the system (via brushes 74 and/or edge rollers 72) come in contact with wall 83, or other corner or obstacle. Turntable 71 is activated, i.e. freely rotates, when such contact occurs, and the side sweeping system 70 turns as a whole in a direction opposite to the direction of movement of apparatus 10.

Those skilled in the art will appreciate that side sweeping system 70 is thus flexibly positioned in a preselected angle and position relative to apparatus 10, such that side sweeping system 70 gives way in contact to walls or obstacles and allows a wet cleaning path comparable or identical to cleaning apparatus without a side-sweeper functionality. The more side sweeping system 70 is positioned in front of the machine, the better the ability of the system to sweeping in corners; as a downside, the wet-cleaning area might be reduced, as steering out of the corner must be started earlier in the process. This limitation can be avoided if side sweeping system 70 is completely swung out of the way.

Figure 8:
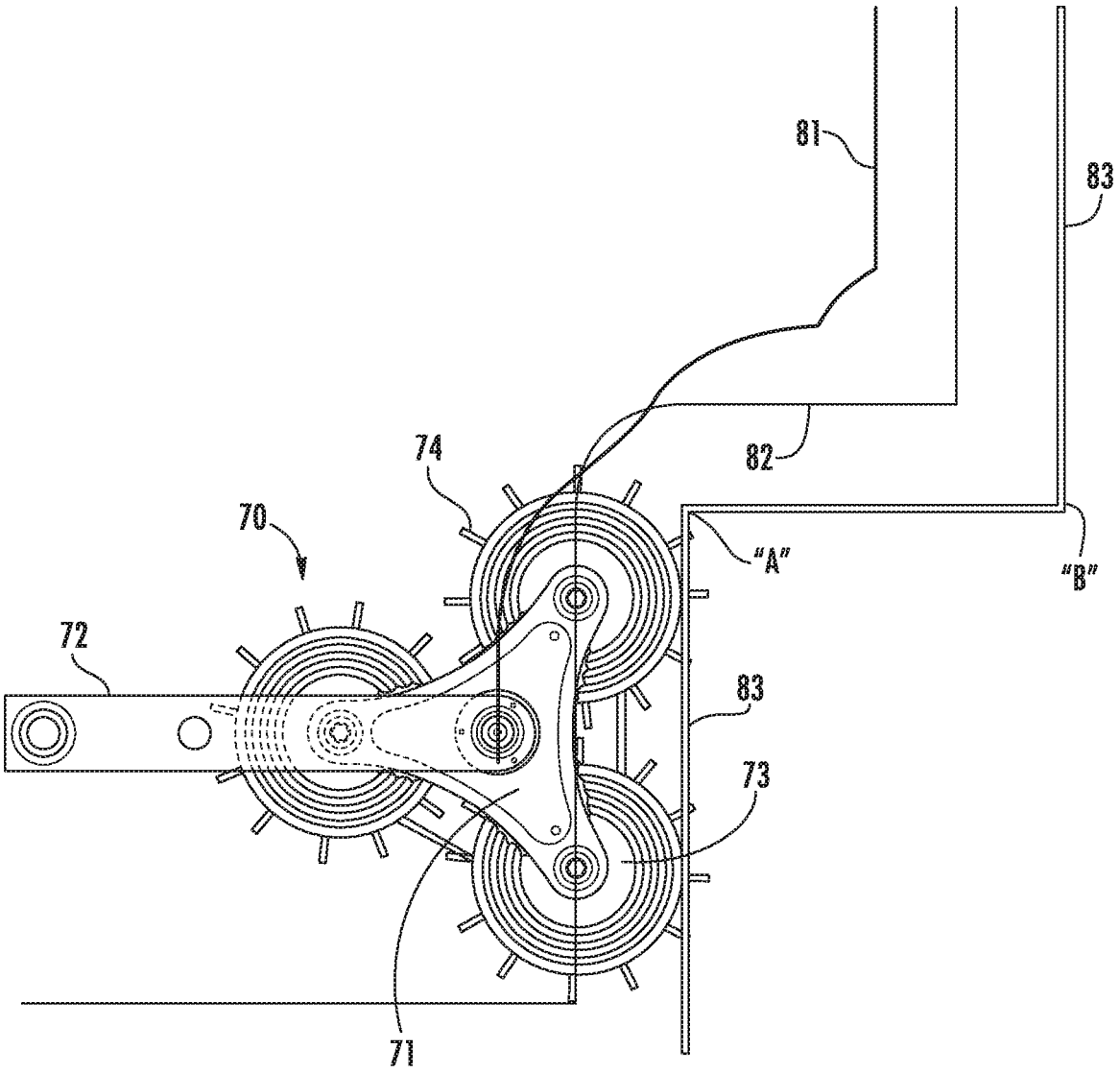
FIG. 8 is a schematic top plan view of a side sweeping assembly at a first position.
Figure 9:
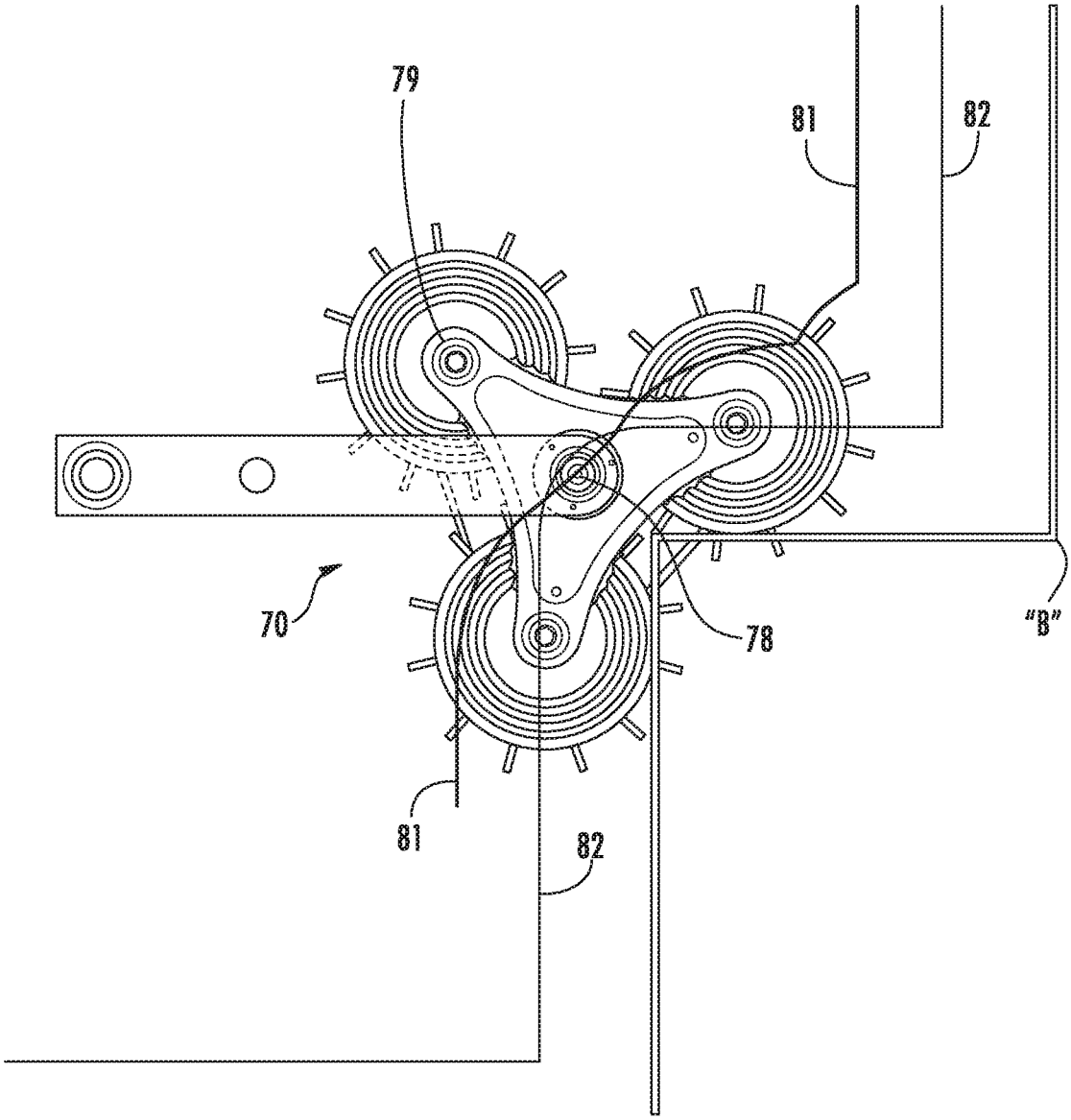
FIG. 9 is a schematic top plan view of a side sweeping assembly at a second position.
Figure 10:
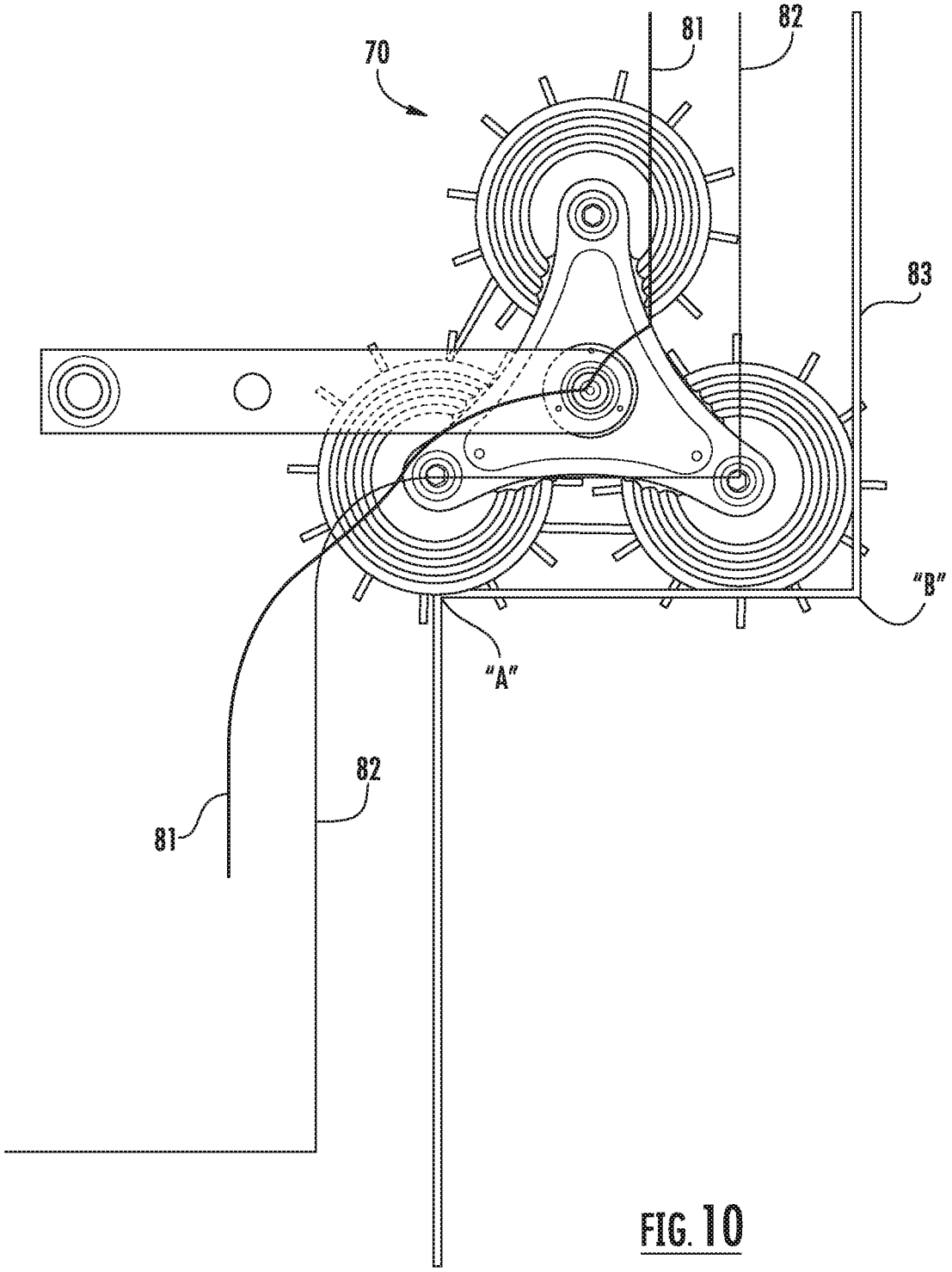
FIG. 10 is a schematic top plan view of a side sweeping assembly at a third position.
Figure 11:
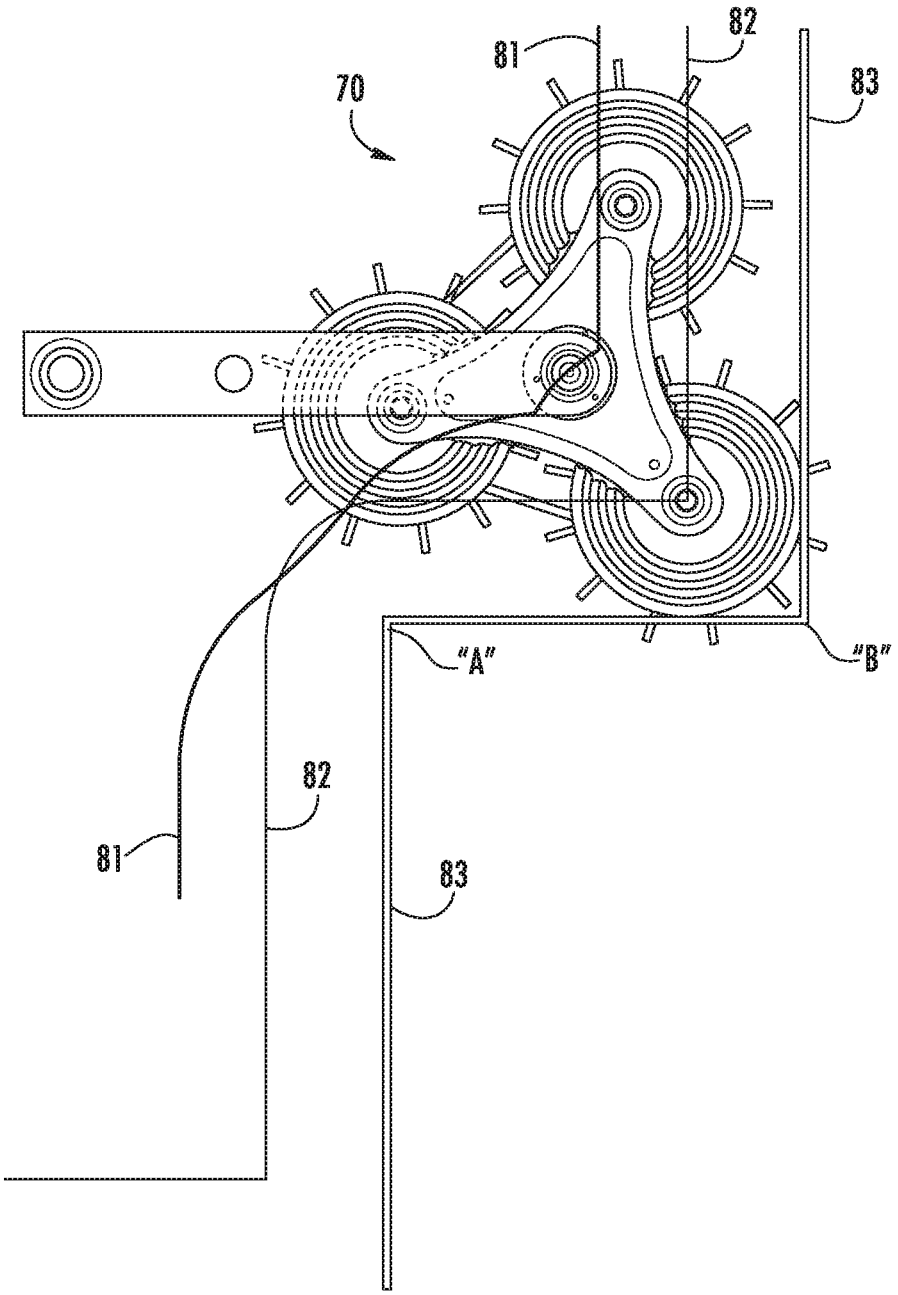
FIG. 11 is a schematic top plan view of a side sweeping assembly at a fourth position.
Figure 13:
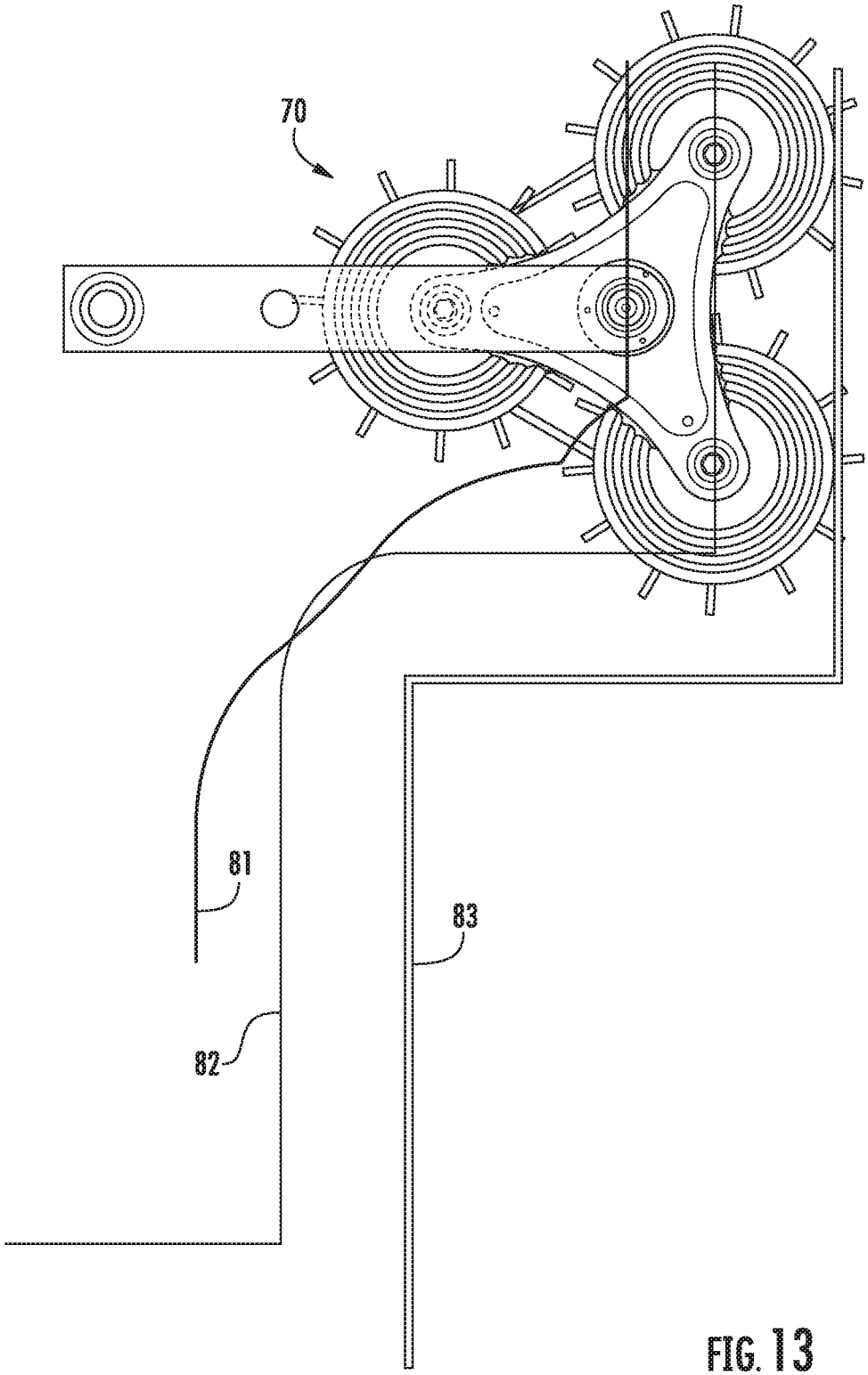
FIG. 13 is a schematic top plan view of a side sweeping assembly at a sixth position.

FIGS. 8 to 13 further illustrate the invention in one embodiment by showing a sweeping progression as an apparatus 10 navigates in a cleaning mode over a floor surface. In FIG. 8, two brushes 74 are in contact with wall 83 and/or the adjacent floor surface. In FIG. 9, apparatus 10 and side sweeping system 70 have advanced such that turntable 71 rotates in reverse (here clockwise) direction as side sweeping system 70 moves around corner "A", while two of the three brushes 74 maintain contact with wall 83 and/or the adjacent floor surface around corner "A". In FIG. 10, side sweeping system 70 has completely turned the corner, and two of the three brushes 74 continue to maintain contact with wall 83 and/or the adjacent floor surface in the area between corner "A" and corner "B". In FIG. 11, as apparatus 10 and side sweeping system 70 further advance, turntable 71 again activates by rotating clockwise. At this location, one brush 74 maintains contact with wall 83 and/or the adjacent floor surface. In FIGS. 12 and 13, the apparatus 10 and side sweeping system 70 advance yet further, two brushes 74 now maintaining contact with wall 83 and/or the adjacent floor surface at corner "B", and then beyond corner "B" along wall 83.

It will be noted that all during the sequence of FIGS. 8 to 13, brushes 74 are actively turning, and debris is being moved from the floor in the area adjacent wall 83, including corners "A" and "B", and toward the front of apparatus 10.

E. Front Sweeping System Operation

Referring especially to FIGS. 1, 2, 3, and 14 to 17, front sweeping system 88 as disclosed hereinabove and can be used alone or in combination with side sweeping system 70 and/or pick-up system 35. At the completion of a cleaning campaign, the collected debris can be left at a desired location by lifting up the brush holder 90, and optionally shaking brush holder 90 to release debris. The debris can then be picked up manually or by using the pick-up system described herein.

F. Pick-Up System Operation

Figure 17:
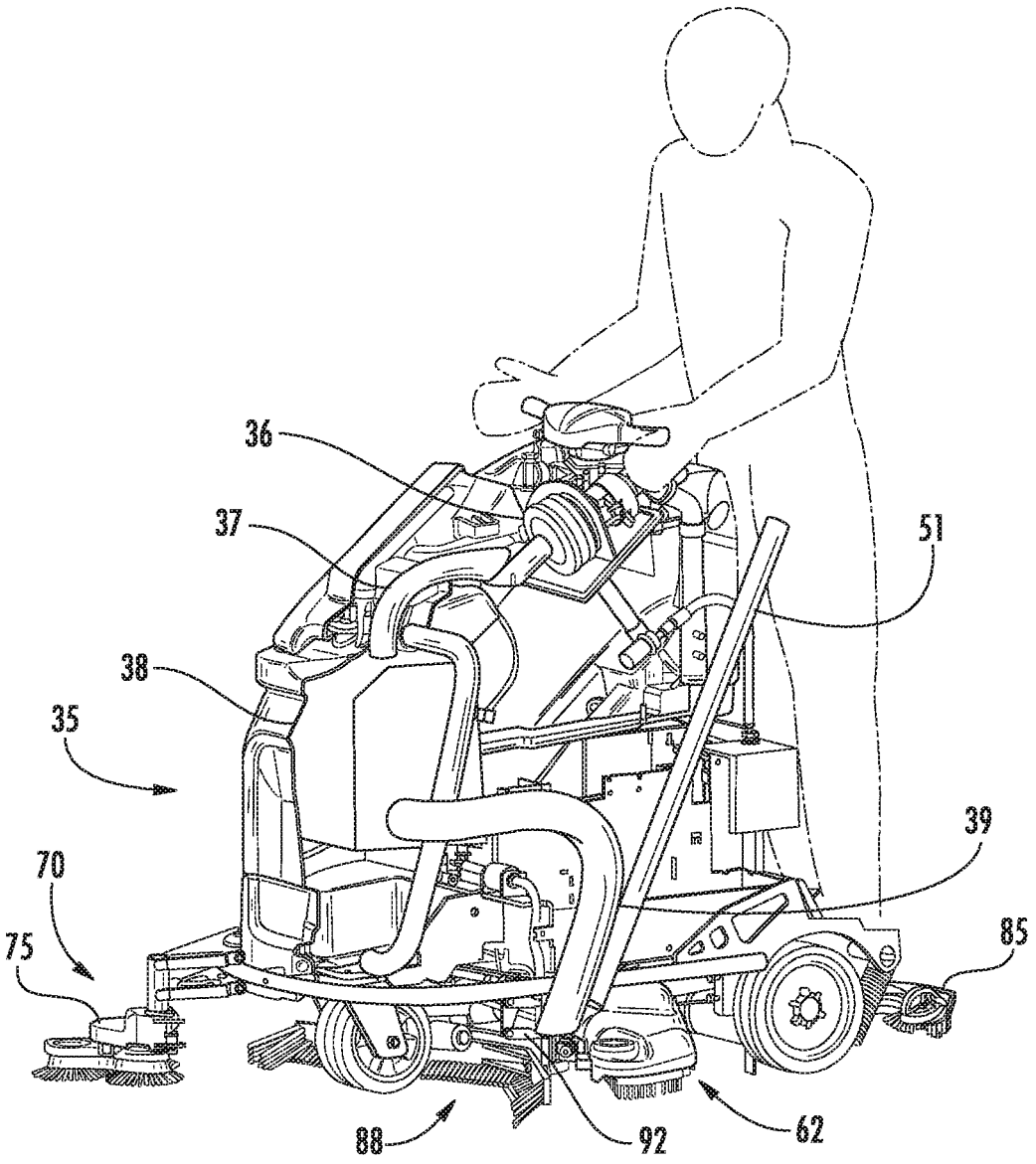
FIG. 17 is a perspective view of relevant portions of a floor cleaning apparatus with a pick-up system.

Referring especially to FIG. 17, an operator can catch debris, e.g. with the front sweeping system 88, and then drive backwards until apparatus 10 is behind the collected debris. The operate can then take bar 51, switch the suction motor 36 from a squeegee assembly 85 mode to a debris pick-up mode, and move the suction hose 37 to the front of suction motor 36. Suction motor is activated and the collected debris is vacuumed off the floor and into debris collection bin 38. Bar 51 is returned to its storage position, and the suction motor is switched back to "normal" (squeegee mode) operation.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

The invention claimed is:

1. A method of cleaning a floor comprising:

a) providing a floor cleaning apparatus, the apparatus adapted to traverse a path of travel, comprising
  i) a housing;
  ii) a chassis;
  iii) a plurality of wheels by which the floor cleaning apparatus is adapted to move across the floor in a direction of travel, the direction of travel at least partially defining a front end, a back end, and first and second lateral sides of the floor cleaning apparatus;
  iv) a motive device for moving the apparatus across the floor;
  v) a steering mechanism;
  vi) a cleaning assembly for cleaning the floor; and
  vii) a side sweeping system comprising
    (a) a turntable having a central axis, and being freely rotatable about said central axis,
    (b) a drive wheel, the drive wheel disposed in coaxial relationship with the turntable,
    (c) a sweeper motive device rotating the drive wheel,
    (d) a plurality of brushes each having a central axis, the brushes distributed radially around the drive wheel and driven by rotation of the drive wheel, and
    (e) a pivoting connector configured to bias the side sweeping system away from the vehicle into a neutral position and to enable the side sweeping system to pivot laterally away from the neutral position in response to contact with a vertical surface while at least one of the plurality of brushes maintains contact with the floor adjacent the vertical surface while the floor cleaning apparatus is in operation; and b) actuating the motive device to move the apparatus across the floor and causing the brushes to move debris that is disposed on the floor adjacent the vertical surface toward the front of the floor cleaning apparatus.

2. The method of claim 1, wherein the side sweeping system further comprises a plurality of edge rollers that are non-driven and extend laterally beyond the turntable, each edge roller mounted under or above the turntable and positioned above and coaxially aligned with a respective brush and wherein the turntable is also not driven and is able to rotate independent of the drive wheel in response to the edge rollers contacting a vertical surface, the method further comprising moving the apparatus and causing one of the plurality of edge rollers to contact the vertical surface thereby causing the turntable to rotate.

3. The method of claim 2 wherein the pivoting connector comprises a deflection biasing member that urges the side sweeping system back to the neutral position when the side sweeping system pivots laterally away from the neutral position in response to contact with a vertical surface, the method further comprising a) moving the apparatus and causing one of the plurality of edge rollers to contact the vertical surface thereby causing the side sweeping system to pivot laterally away from the neutral position, and b) further moving the apparatus and causing the one of the plurality of edge rollers to move away from the vertical surface thereby allowing the deflection biasing member to urge the side sweeping system back towards the neutral position.

4. The method of claim 1, wherein the floor cleaning apparatus further comprises a front sweeping system comprising a segmented brush holder comprising a first segment and a second segment, a plurality of front sweeper brushes distributed along the length of the brush holder, and a first biasing member attaching the first segment to the second segment, such that in operation the first segment can swing away from the second segment in response to debris caught by the brushes, the method further comprising moving the apparatus across the floor and causing the brushes to move debris that is disposed on the floor adjacent the vertical surface into the front sweeping system.

5. The method of claim 1, wherein the floor cleaning apparatus further comprises a pick- up system comprising a suction hose connected to a debris collection bin, a suction motor, and a pick-up hose in communication with the collection bin, the method further comprising activating the suction motor and picking up debris from the floor through the pick-up hose and depositing the debris in the collection bin.

6. The method of claim 1 further comprising supporting a weight of the side sweeping system so that the brushes are suspended at a desired position above the floor.

7. The method of claim 6 wherein the step of supporting a weight of the side sweeping system is performed by a biasing system providing a lifting force from above the side sweeping system or by a low-friction body disposed under the side sweeping system and in contact with the floor.

8. A method of cleaning a floor comprising:

a) providing a floor cleaning apparatus, the apparatus adapted to traverse a path of travel, comprising
  i) a housing;
  ii) a chassis;
  iii) a plurality of wheels by which the floor cleaning apparatus is adapted to move across the floor in a direction of travel, the direction of travel at least partially defining a front end, a back end, and first and second lateral sides of the floor cleaning apparatus;
  iv) a cleaning assembly for performing a desired function upon the floor; and
  v) a side sweeping system comprising
    (a) a turntable having a central axis, and being freely rotatable about said central axis,
    (b) a drive wheel, the drive wheel disposed in coaxial relationship with the turntable,
    (c) a sweeper motive device rotating the drive wheel,
    (d) a plurality of brushes each having a central axis, the brushes distributed radially around the drive wheel and driven by rotation of the drive wheel, and (e) a pivoting connector configured to bias the side sweeping system away from the vehicle into a neutral position and to enable the side sweeping system to pivot laterally away from the neutral position in response to contact with a vertical surface while at least one of the plurality of brushes maintains contact with the floor adjacent the vertical surface while the floor cleaning apparatus is in operation; and b) moving the apparatus across the floor and causing the brushes to move debris that is disposed on the floor adjacent the vertical surface toward the front of the floor cleaning apparatus.

9. The method of claim 8, wherein the side sweeping system further comprises a plurality of edge rollers that are non-driven and extend laterally beyond the turntable, each edge roller mounted under or above the turntable and positioned above and coaxially aligned with a respective brush and wherein the turntable is also not driven and is able to rotate independent of the drive wheel in response to the edge rollers contacting a vertical surface, the method further comprising moving the apparatus and causing one of the plurality of edge rollers to contact the vertical surface thereby causing the turntable to rotate.

10. The method of claim 9 wherein the pivoting connector comprises a deflection biasing member that urges the side sweeping system back to the neutral position when the side sweeping system pivots laterally away from the neutral position in response to contact with a vertical surface, the method further comprising a) moving the apparatus and causing one of the plurality of edge rollers to contact the vertical surface thereby causing the side sweeping system to pivot laterally away from the neutral position, and b) further moving the apparatus and causing the one of the plurality of edge rollers to move away from the vertical surface thereby allowing the deflection biasing member to urge the side sweeping system back towards the neutral position.

11. The method of claim 8, wherein the floor cleaning apparatus further comprises a front sweeping system comprising a segmented brush holder comprising a first segment and a second segment, a plurality of front sweeper brushes distributed along the length of the brush holder, and a first biasing member attaching the first segment to the second segment, such that in operation the first segment can swing away from the second segment in response to debris caught by the brushes, the method further comprising moving the apparatus across the floor and causing the brushes to move debris that is disposed on the floor adjacent the vertical surface into the front sweeping system.

12. The method of claim 8, wherein the floor cleaning apparatus further comprises a pick- up system comprising a suction hose adapted to be connected to a debris collection bin, a suction motor, and a pick-up hose in communication with the collection bin, the method further comprising activating the suction motor and picking up debris from the floor through the pick-up hose and depositing the debris in the collection bin.

13. The method of claim 8 further comprising supporting a weight of the side sweeping system so that the brushes are suspended at a desired position above the floor.

14. The method of claim 13 wherein the step of supporting a weight of the side sweeping system is performed by a biasing system providing a lifting force from above the side sweeping system or by a low-friction body disposed in contact with the side sweeping system and with the floor.

15. The method of claim 14, wherein the low-friction body comprises a central turntable column comprising a ball transfer unit that descends from the turntable and contacts the floor.

16. The method of claim 8, further comprising engaging a lifting device to vertically lift the side sweeping system.

17. The method of claim 8, further comprising engaging an agitator to shake the brushes on the side sweeping system.

18. A method of treating a floor comprising:

providing a floor cleaning apparatus for performing a desired treatment on a floor, the floor cleaning apparatus comprising:

A. a housing;

B. a chassis;

C. a plurality of wheels by which the floor cleaning apparatus is adapted to move across the floor in a direction of travel, the direction of travel at least partially defining a front end, a back end, and first and second lateral sides of the floor cleaning apparatus;

D. a cleaning assembly for performing the desired treatment on the floor;

E. a front sweeping system comprising a segmented brush holder comprising a first segment and a second segment, a plurality of front sweeper brushes distributed along the length of the brush holder, and a first biasing member attaching the first segment to the second segment, such that in operation the first segment can swing away from the second segment in response to debris caught by the front sweeper brushes;

F. a side sweeping system comprising i) a turntable having a central axis, ii) a drive wheel, the drive wheel disposed in coaxial relationship with the turntable, iii) a sweeper motive device for rotating the drive wheel about the central axis, the turntable not driven by the sweeper motive device but also freely rotatable about the central axis independent of the drive wheel, iv) a plurality of brushes each having a central axis, the brushes assembled to the turntable and distributed radially around the drive wheel and driven by rotation of the drive wheel, v) a plurality of edge rollers that are non-driven and extend laterally beyond the turntable, each edge roller positioned above and coaxially aligned with a respective brush, and vi) a pivoting connector configured to enable the side sweeping system to pivot laterally away from a neutral position in response to contact with a vertical surface while at least one of the plurality of brushes maintains contact with the floor adjacent the vertical surface while the floor cleaning apparatus is in operation, and moving the apparatus across the floor and causing the brushes to move debris that is disposed on the floor adjacent the vertical surface toward the front sweeping system.

19. The method of claim 18, further comprising engaging a lifting device to vertically lift one of the side sweeping system or the front sweeping system.

20. The method of claim 18, further comprising engaging an agitator to shake the brushes on one of the side sweeping system or the front sweeping system.

* * * * *